US008120537B2

(12) United States Patent
del Rio et al.

(10) Patent No.: US 8,120,537 B2
(45) Date of Patent: Feb. 21, 2012

(54) INCLINED ANTENNA SYSTEMS AND METHODS

(75) Inventors: Daniel Llorens del Rio, Lausanne (CH); Ferdinando Tiezzi, Renens (CH); Stefano Vaccaro, Gland (CH); Noel Lopez, Phoenix, AZ (US); John Filreis, Mesa, AZ (US)

(73) Assignee: ViaSat, Inc., Carlsbad, CA (US)

( * ) Notice: Subject to any disclaimer, the term of this patent is extended or adjusted under 35 U.S.C. 154(b) by 349 days.

(21) Appl. No.: 12/463,101

(22) Filed: May 8, 2009

(65) Prior Publication Data

US 2010/0052994 A1 Mar. 4, 2010

Related U.S. Application Data

(63) Continuation-in-part of application No. 12/274,994, filed on Nov. 20, 2008.

(60) Provisional application No. 61/127,087, filed on May 9, 2008, provisional application No. 61/127,071, filed on May 9, 2008.

(51) Int. Cl.
*H01Q 1/38* (2006.01)

(52) U.S. Cl. ..... 343/700 MS; 343/848

(58) Field of Classification Search ..... 343/700 MS, 343/702, 848, 853, 893
See application file for complete search history.

(56) References Cited

U.S. PATENT DOCUMENTS

| | | | | |
|---|---|---|---|---|
| 4,450,449 | A * | 5/1984 | Jewitt | 343/700 MS |
| 6,839,039 | B2 * | 1/2005 | Tanaka et al. | 343/824 |
| 6,999,036 | B2 | 2/2006 | Stoyanov et al. | |
| 7,369,098 | B2 * | 5/2008 | Chen | 343/893 |
| 7,502,764 | B2 | 3/2009 | Son et al. | |
| 7,768,469 | B2 * | 8/2010 | Mansour et al. | 343/757 |
| 2003/0087674 | A1 * | 5/2003 | Li et al. | 455/562 |
| 2004/0017316 | A1 | 1/2004 | Tanaka et al. | |
| 2005/0146473 | A1 | 7/2005 | Stoyanov et al. | |
| 2006/0132372 | A1 | 6/2006 | Jung et al. | |
| 2010/0328161 | A1 * | 12/2010 | Tiezzi et al. | 343/700 MS |

FOREIGN PATENT DOCUMENTS

| | | |
|---|---|---|
| JP | 2040931 | 2/1990 |
| JP | 7202564 | 8/1995 |
| JP | 2004120325 | 4/2004 |

(Continued)

OTHER PUBLICATIONS

ISR and Written Opinion from corresponding Int'l Application No. PCT/US09/043321 dated Dec. 28, 2009.

(Continued)

*Primary Examiner* — Tan Ho
(74) *Attorney, Agent, or Firm* — Snell & Wilmer L.L.P.

(57) ABSTRACT

In accordance with various aspects of the present invention, a method and system for designing an inclined antenna array with a hybrid mechanical-electronic steering system with improved radiation performances at low elevation angles is presented. In an exemplary embodiment, a radiating element structure is attached to a mounting surface and includes a patch antenna and a ground plane. The bottom edge of the patch antenna is farther from the mounting surface than the top edge of the patch antenna. If the radiating element structure is used in an inclined array antenna, then the patch antenna has an uncovered view of a low elevation angle. Furthermore, at least a portion of a patch antenna may be uncovered and have a clear view. A clear view of the low elevation angle results in increased directivity and increased polarization quality due to reduced signal scattering.

23 Claims, 25 Drawing Sheets

FOREIGN PATENT DOCUMENTS

| | | |
|---|---|---|
| JP | 2005136756 | 5/2005 |
| KR | 10-2005-0109320 | 11/2005 |

OTHER PUBLICATIONS

International Preliminary Report on Patentability dated Nov. 18, 2010, PCT/US2009/043321.

PCT; International Preliminary Report on Patentability dated Nov. 18, 2010 in Application No. PCT/US2009/043233.

PCT; International Search Report and Written Opinion dated Dec. 30, 2009 in Application No. PCT/US2009/043233.

USPTO; Office Action Restriction dated Mar. 7, 2011 in U.S. Appl. No. 12/274,994.

A Novel Mobile Antenna for Ku-Band Satellite Communications, Ung Hee Park et al. ETRI Journal, vol. 27, No. 3, Jun. 2005.

Suited Demonstration Results of a Mobile Terminal for Heterogeneous Satellite-Terrestrial Network Access, M. Holzbock, A. Jahn, J. Alonzo, Z. Golubicic, V. Schena, F. Ceprani, J. Torres, M. Memar.

* cited by examiner

PRIOR ART 2001
2015
2010
2005
2003

PRIOR ART

INCLINED ANTENNA SYSTEMS AND METHODS

RELATED APPLICATION

This application claims priority to U.S. Provisional Application No. 61/127,087, filed May 9, 2008, and entitled "INCLINED ANTENNA SYSTEMS AND DEVICES". This application is also a continuation-in-part of and claims priority to U.S. patent application Ser. No. 12/274,994, filed Nov. 20, 2008, and entitled "LOW COST MODULAR SUBARRAY SUPER COMPONENT", which claims priority to U.S. Provisional Application No. 61/127,071, filed May 9, 2008, and entitled "LOW COST MODULAR SUBARRAY SUPER COMPONENT", all of which are hereby incorporated by reference.

FIELD OF INVENTION

The present invention relates to the structure of a radiating element and to the configuration of an array of radiating elements of a hybrid steerable beam antenna.

BACKGROUND OF THE INVENTION

Many existing and future mobile vehicular applications require high data rate broadcasting systems ensuring full continental coverage. With respect to terrestrial networks, satellite broadcasting allows having continuous and transnational coverage of a continent, including rural areas. Among existing satellite systems, Ku-band capacity is widely available in Europe, North America and most of the other regions in the world and can easily handle, at a low cost, fast and high-capacity communications services for commercial, military and entertainment applications.

The application of Ku-band to mobile terminals typically requires the use of automatic tracking antennas that are able to steer the beam in azimuth, elevation and polarization to follow the satellite position while the vehicle is in motion. Moreover, the antenna should be "low-profile", small and lightweight, thereby fulfilling the stringent aerodynamic and mass constraints encountered in the typical mounting of antennas in airborne and automotive environments.

Typical approaches for beam steering are full mechanical scan or full electronic scan. The main disadvantages of the first approach for mobile terminals is the bulkiness of the structure due to the size and weight of mechanical parts, the reduced reliability because mechanical moving parts are more subject to wear and tear than electronic components, and high assembling costs making the approach less suitable for mass production. In comparison, the main drawback of fully electronic steering is that the antenna requires the integration of a lot of expensive analog RF electronic components which may prohibitively raise the cost for commercial applications.

An advantageous approach is to use a "hybrid" steerable beam antenna implementing a mechanical rotation in azimuth and electronic scanning in elevation. This approach requires only a simple single axis mechanical rotation and a reduced number of electronic components. These characteristics allow for maintaining a low production cost due to reduced mechanical parts and electronic components, reducing the size and the "height" of the antenna which is important in airborne and automotive applications, and having a better reliability factor than a fully mechanical approach due to fewer mechanical parts.

The ideal requirement for steerable beam antennas is to be capable of orientating the beam in any direction while maintaining a similar level of performance in all directions. This is possible only with mechanically steerable antennas having the freedom to rotate in any direction.

The performances of low-profile planar antennas mounted on a horizontal surface are typically decreased at low elevation angles due to a size reduction of the equivalent surface projected in the direction of the satellite. The use of antenna arrays with a hybrid steering mechanism (azimuth rotation) allows optimization of the radiating element pattern in a preferred direction.

Another advantageous antenna configuration is achieved by inclining the radiating elements in order to better focus the radiated power toward low elevation angles. Shaping of the radiation pattern does not allow an increase in the absolute level of the antenna performances, which has a maximum limit imposed by the equivalent surface, but it does allow a reduction in the number of elements in the array and hence reduces the number of electronic components required to electronically steer the beam in elevation.

However, the use of inclined radiating elements has generally important limitations on the radiation at low elevation due to the blockage of the field of view for the elements behind the first row. Thus, there is a need for a system and method for increasing the efficiency of an antenna at low elevation scanning.

SUMMARY OF THE INVENTION

This application presents an approach to design an inclined antenna array with a hybrid mechanical-electronic steering system with improved radiation performances at low elevation angles. The application of original design concepts allows building an antenna joining performances at low elevation angles, low-cost, low-profile and lightweight characteristics.

In an exemplary embodiment, a radiating element structure is attached to a mounting surface and includes a patch antenna and a ground plane. The bottom edge of the patch antenna is farther from the mounting surface than the top edge of the patch antenna. If the radiating element structure is used in an inclined array antenna, then the patch antenna has an uncovered view of a low elevation angle. A clear view of the low elevation angle results in increased directivity and increased polarization quality due to reduced signal scattering.

In another exemplary embodiment, an inclined element array antenna includes a first radiating element having a first ground plane and a first patch antenna, and a second radiating element having a second ground plane and a second patch antenna. The first radiating element is located in front of the second radiating element on a mounting surface. In the exemplary embodiment, the second patch antenna of the second radiating element is configured to have a clear line of sight to the horizon over the first ground plane of the first radiating element.

In yet another exemplary embodiment, an antenna system includes a first row of radiating elements having at least a first and second radiating element, and a second row of radiating elements having at least a third and fourth radiating element. The first and second radiating elements are spaced apart by a distance of at least the width of the third radiating element. Additionally, the third radiating element is aligned with the spacing between the first and second radiating element so that the third radiating element is not blocked by the first row of radiating elements from a frontal perspective. Furthermore, the third and fourth radiating elements are spaced apart by a distance of at least the width of the second radiating element, and the second radiating element is positioned to align with the spacing between the third and fourth radiating elements.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

Figure 18:
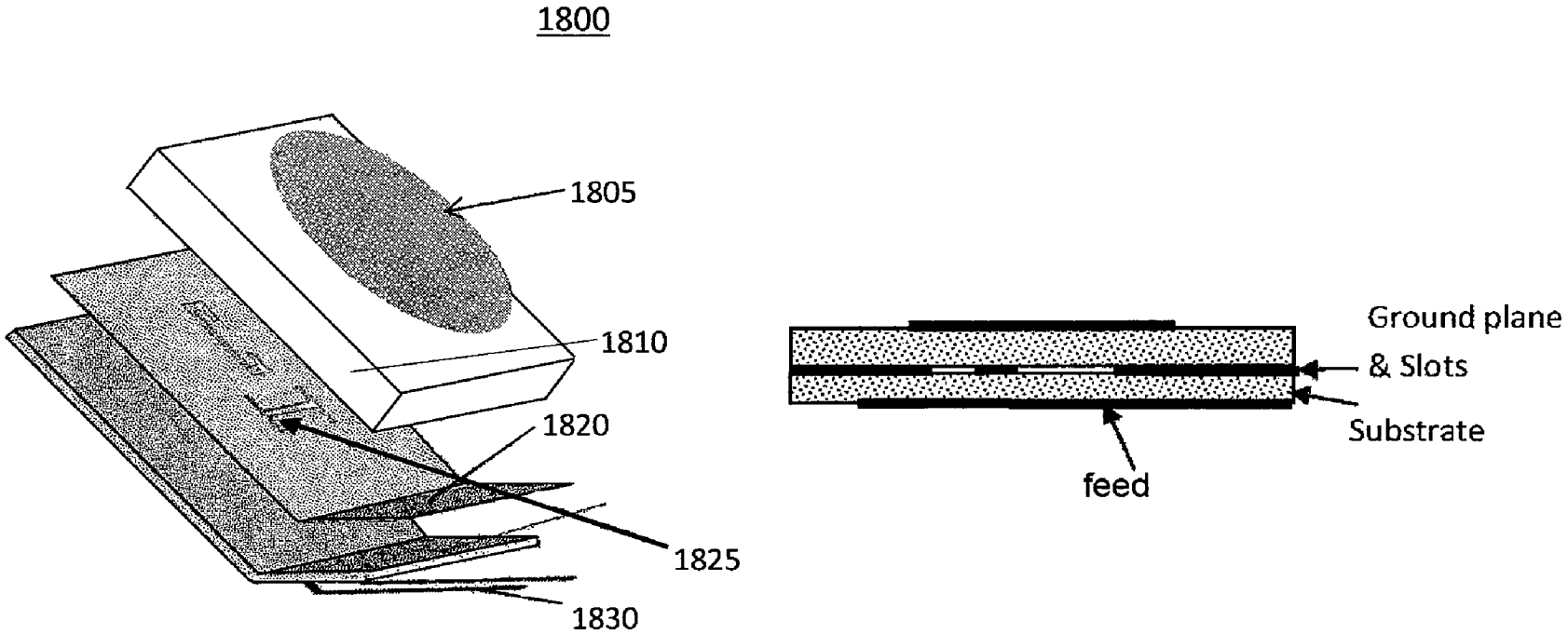
FIG. 18 shows an exemplary embodiment of a radiating element structure.

In an exemplary embodiment, and with reference to FIG. 18, a radiating element structure 1800 comprises a patch antenna 1805, a dielectric layer 1810, a ground plane 1820, and a microstrip line 1830. The ground plane 1820 is located between microstrip line 1830 and dielectric layer 1810. In an exemplary embodiment, radiating element structure 1800 is a microstrip-fed aperture-coupled patch antenna. In another embodiment, the patch antenna 1805 could also be at least one of a dipole, a ring, and any other suitable radiating element. In a further exemplary embodiment, radiating element structure 1800 is a dual polarized radiating element with a ground plane 1820, which comprises an orthogonal slot feed 1825. For illustration purposes, the dual polarization of the radiating element will be limited to horizontal and vertical polarizations.

Figure 19:
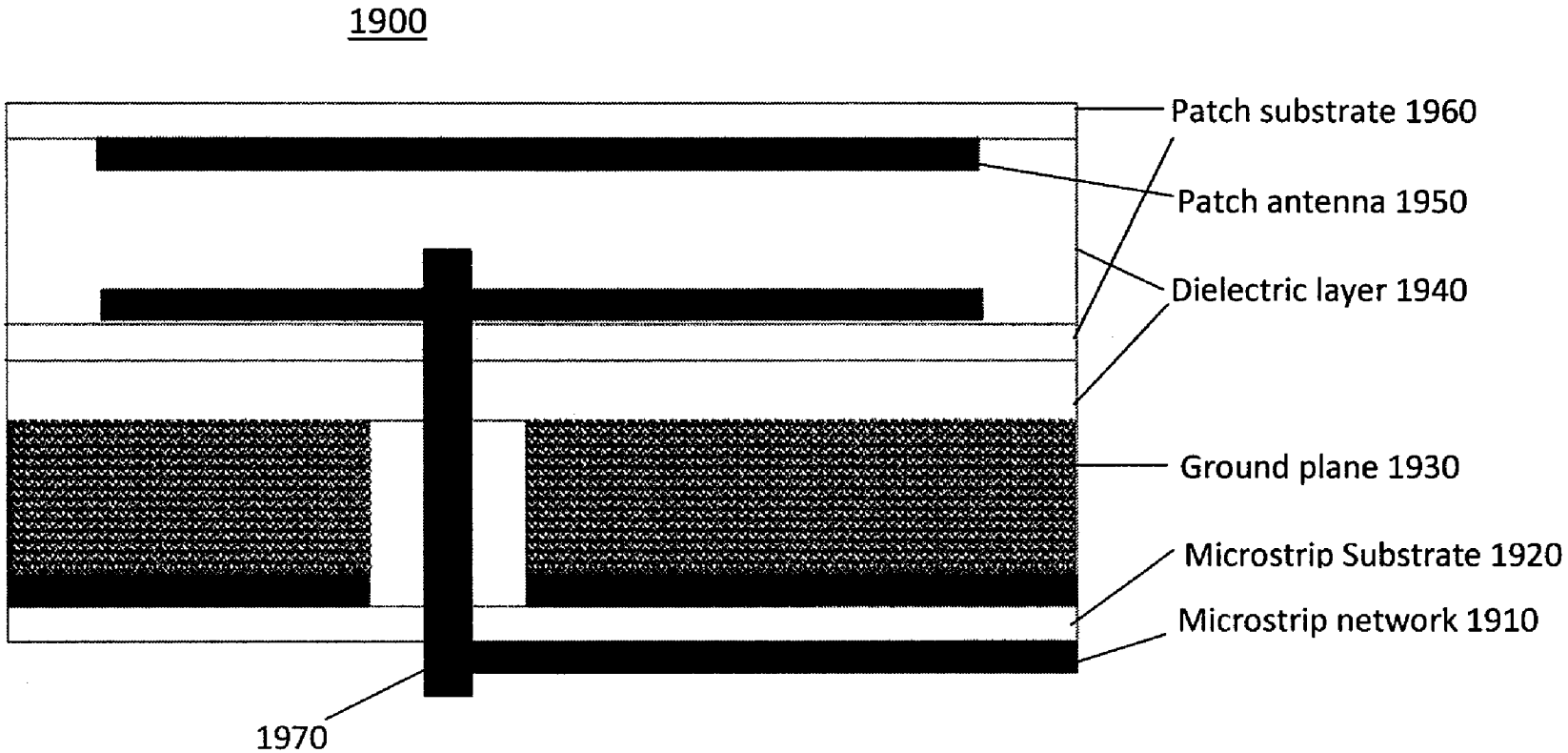
FIG. 19 shows an exemplary embodiment of a radiating element structure having multiple patch antennas.

Radiating element structure 1800 can be configured in different suitable embodiments. For example, in one exemplary embodiment and with reference to FIG. 19, a radiating element structure 1900 may comprise a microstrip line 1910, a microstrip line substrate 1920, a ground plane 1930, at least one dielectric layer 1940, at least one patch substrate 1960, and at least one patch antenna 1950 with a probe fed excitation 1970. In a second exemplary embodiment, radiating element structure 1900 comprises two or more dielectric layers 1940, two or more patch antennas 1950, two or more patch substrates 1960, or any combination thereof. Although exemplary structures are described herein for radiating element structure 1900, it should be understood that many different structures may be used consistent with that which is disclosed herein.

The dielectric layer separates other antenna assembly components. In an exemplary embodiment, the dielectric material is a foam material. For example, the foam may be Rohacell HF with a gradient of 31, 51 or 71. Moreover, dielectric material may be any suitable material as would be known in the art. In an exemplary embodiment, dielectric layer 1940 may be air or any material that separates patch antenna 1950 from ground plane 1930 and allows radio frequency (RF) signals to pass.

Furthermore, in an exemplary embodiment, radiating element structure 1800, 1900 is configured to receive signals in the Ku-band, which is approximately 10.7-14.5 GHz. In another embodiment, radiating element structure 1800, 1900 is configured to receive signals in the Ka-band, which is approximately 18.5-30 GHz. In yet another embodiment, radiating element structure 1800, 1900 is configured to receive signals in the Q band, which is approximately 36-46 GHz. In other exemplary embodiments, radiating element structures may be configured to receive any suitable frequency band. Additionally, in an exemplary embodiment, radiating element structure 1800, 1900 is part of an antenna configured to scan at least 20° above horizon or lower.

Furthermore, though the radiating elements and antenna system described herein is referenced in terms of receiving a signal, the antenna system is not so limited. Accordingly, in an exemplary embodiment, the radiating element structures may be configured to transmit a signal at various frequencies, similar to the receiving of signals. In another exemplary embodiment, the radiating element structures may be configured to transmit and receive signals at various frequencies.

In an exemplary embodiment, the systems and methods described herein may applicable to linear polarized signals. In another exemplary embodiment, the systems and methods described herein may be applicable to circular polarized signals. Additionally, the systems and methods described herein may be applicable to non-linear polarized signals.

In an exemplary embodiment, ground plane 1820 is made of metal. Ground plane 1820 may be a continuous or discontinuous piece of metal. Furthermore, ground plane 1820 may be made of any suitable material that prevents the transmission of spurious radiation as would be known in the art. In an exemplary embodiment, ground plane 1820 is located between, and separates, patch antenna 1805 and the circuitry, all of which are on separate planes. The radiation from patch antenna 1805 does not pass through ground plane 1820, thereby substantially isolating patch antenna 1805 and microstrip line 1830 from each other. This isolation improves the RF signals by decreasing mutual-inference from circuitry radiation and the patch antenna radiation.

Figures 20A, 20B, 20C:
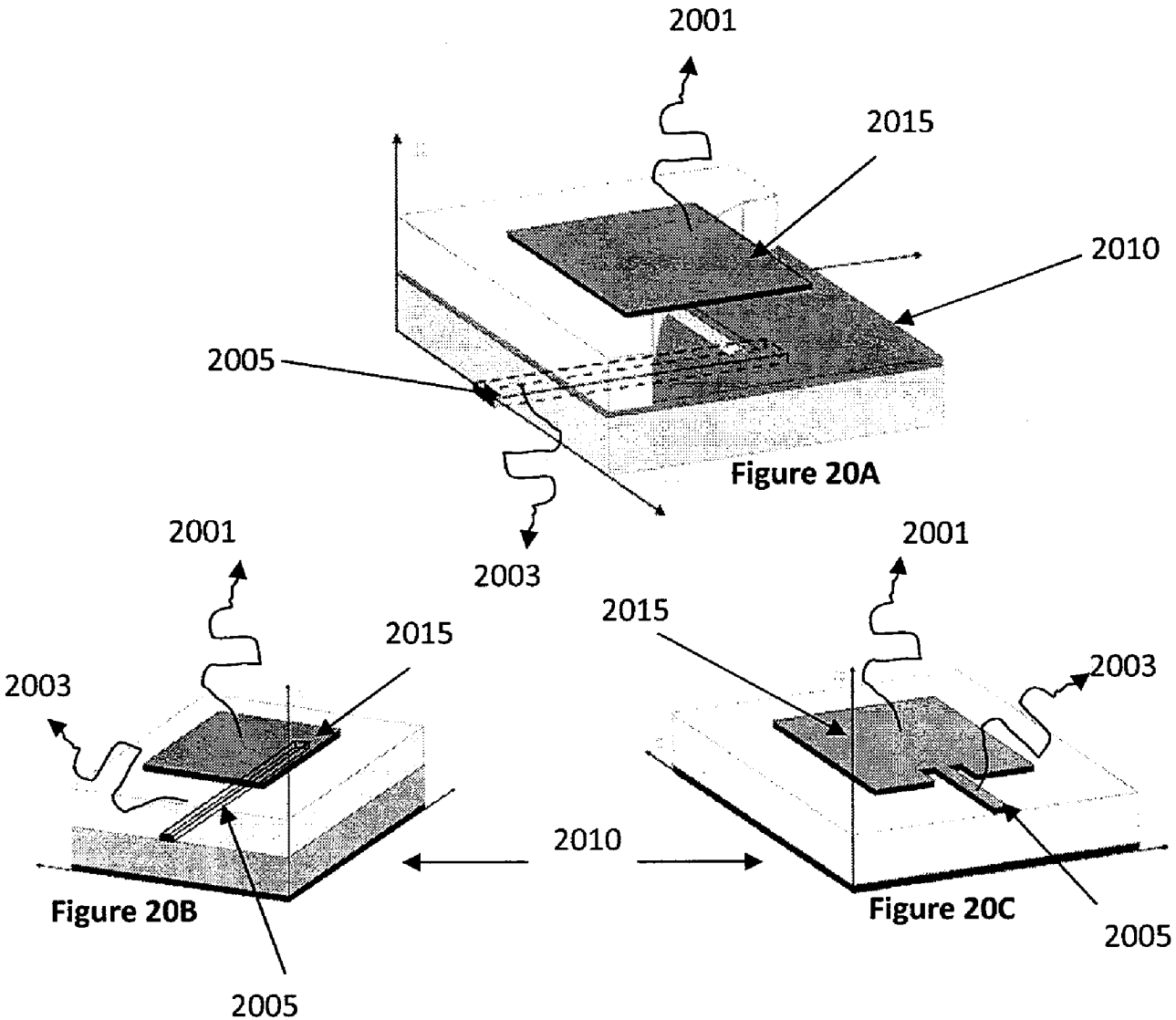
FIGS. 20A-20C show embodiments of radiating element structures with different ground plane configurations.

In the exemplary embodiment the feed line is below the ground plane, which substantially prevents the feed line from radiating in the direction of the patch antenna. In an exemplary embodiment the aperture coupling mechanism allows the separation between radiating elements and antenna circuitry, such as feed networks and other active components, into at least two separate layers and prevents or substantially prevents the spurious radiation from the antenna circuitry from affecting the radiation pattern of the antenna. In an exemplary embodiment, and with reference to FIG. 20A, a radiating element structure comprises a ground plane 2010 located below a patch antenna 2015 and above a feed line 2005. From this arrangement, radiation 2001 from patch antenna 2015 radiates away from ground plane 2010 and radiation 2003 from feed line 2005 radiates in the opposite direction. In contrast, as depicted in FIG. 20B and FIG. 20C, if a feed line 2005 is on the same side of a ground plane 2010 as a patch antenna 2015 with respect to ground plane 2010, then feed line 2005 can radiate as well as patch antenna 2015. This can have a very negative effect by affecting the purity of polarization.

The complete or substantially complete separation of the feed circuit layer from the radiating circuit layer allows for separately optimizing the materials and the design of the two parts of the antenna. Typically, requirements for microwave circuits and antennas are very different: microwave circuits often use "high permittivity" dielectric substrates to reduce the size of the circuit, reduce the lines' spurious radiated power and the coupling between the lines. On the other hand, patch antennas are typically based on "low-permittivity" dielectric substrates that facilitate higher radiation efficiency, lower losses and larger bandwidth. Further information on permittivity of substrates used in patch antennas is described in a text written by Fred E. Gardiol and Francois Zürcher, entitled "Broadband Patch Antennas", published by Artech House (1995).

The two requirements are clearly in contrast when the radiators and the feed lines are on the same side of the ground plane and are forced to share the same dielectric material. The separation of feed circuit and radiators in two boards may simplify the design because the designer has two complete boards to adjust all components and does not have to heavily consider the possible interactions (couplings) between feed circuits and radiators. This structure facilitates locating lines and/or components very close to the slots without affecting the radiation characteristics. In typical prior art configurations with feed circuit and radiators on the same side of the ground plane, it is preferable to leave empty the whole surface under the patches, which is a larger surface than that occupied by the slots.

In accordance with an exemplary embodiment and with renewed reference to FIG. 18, ground plane 1820 comprises slot feed 1825, which allows signals to communicate between patch antenna 1805 and microstrip line 1830. In an exemplary embodiment, slot feed 1825 excites a very pure resonant mode on the patch antenna with a very low cross polarization component. This excitation method provides much better polarization results than other feed models, such as line feed, coaxial-pin feed, and electromagnetic coupling feed. In an exemplary embodiment, the cross polarization level is below about −15 dB. In another exemplary embodiment, the cross polarization level is below about −25 dB. The cross polarization can be at other levels as well in other exemplary embodiments.

The slot feed 1825 is used to couple the power from the microstrip lines to the patch antennas. In one embodiment, the shape of slot feed 1830 may be arbitrary. In an exemplary embodiment, and with reference to FIG. 18, the ground plane may include two slots substantially orthogonal to each other. In another embodiment, the ground plane may include an "H"-shaped slot and a "C"-shaped slot, where one slot is horizontally orientated and the other is vertically orientated. Furthermore, in yet another embodiment, slot feed 1830 may be orientated at any angle while the two slots are still substantially orthogonal to each other. This embodiment provides good isolation between the two slots allowing better purity of the polarized signals. In an exemplary embodiment, the size of slot feed 1830 is optimized in order to obtain the best matching. The optimization may be accomplished using computer simulations and optimization. In one embodiment, the length of slot feed 1830 is smaller than half the signal wavelength ($\lambda/2$).

The benefits of using an "H"-shaped slot include a more compact size compared to a linear slot and offering a smaller required surface for coupling with patch antenna 1805. The shorter slot length allows a reduction of the direct radiation from the slot itself, which radiates both forward and backward. In other words, an "H"-shaped slot can help to reduce unwanted backward radiation. Moreover, more radiating elements can be fit in the same space with a compact "H"-shaped slot, or any similar compact slot, than with a linear slot or the like. In addition, a compact slot design increases the polarization purity as described above, and ensures a low coupling between two orthogonal polarizations.

In accordance with an exemplary embodiment, a radiating element structure, sometimes referred to as a stacked resonator structure, includes more than one radiating element, a ground plane, a feed element, and dielectric layers located between the other components. In accordance with an exemplary embodiment, and with renewed reference to FIG. 19, radiating element structure 1900 comprises two coupled radiating elements based on the use of stacked patch antenna resonators 1950. In an exemplary embodiment, the feed element is one of a line, a waveguide, a coaxial probe, a slot, or any combination thereof. Additionally, in one embodiment, stacked patch antennas 1950 are optimized for transmit frequency bands. In another embodiment, stacked patch antennas 1950 are optimized for receive frequency bands. In yet another exemplary embodiment, stacked patch antennas 1950 are optimized to increase the antenna bandwidth to allow adjacent transmit and receive frequency bands.

Figure 21:
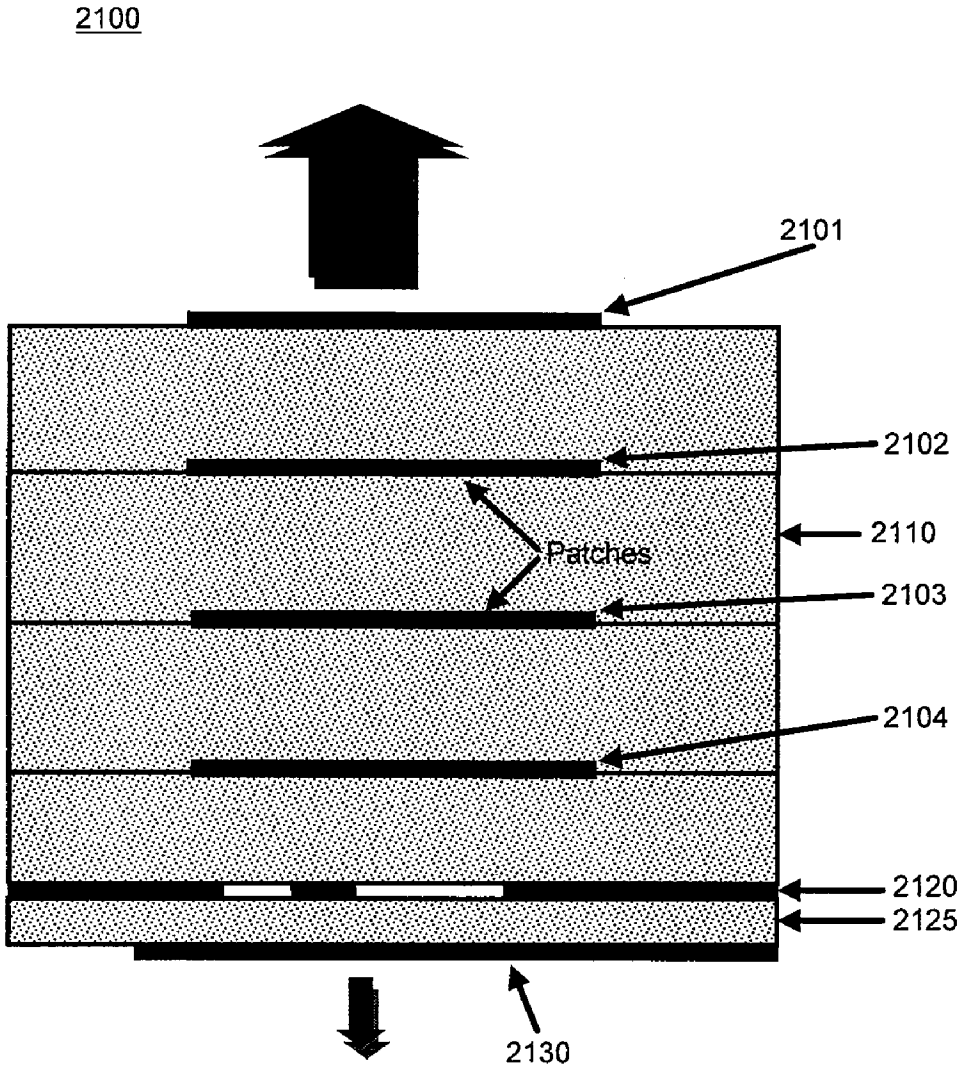
FIG. 21 shows another exemplary embodiment of a radiating element structure having multiple patch antennas.

In another exemplary embodiment and with reference to FIG. 21, a radiating element structure 2100 comprises four radiating elements 2101-2104. The two radiating elements 2101 and 2102 positioned farthest from a ground plane 2120 are coupled and may be configured to improve the front-to-back ratio of radiation. The other two radiating elements 2103 and 2104 positioned nearest to ground plane 2120 are coupled and may be configured to improve the bandwidth.

Furthermore, in an exemplary embodiment, radiating element structure 2100 comprises multiple radiating elements and may be stacked to facilitate placing at least one radiating element a substantial distance from ground plane 2120 further than otherwise could be done without stacking the components. In an exemplary embodiment, radiating element 2104 is positioned from a feed slot 2125 in the range of approximately 0.05λ-0.25λ. Positioning a radiating element far away from feed slot 2125 results in a considerable reduction of coupled energy. This reduction would result in a loss of efficiency, reduced bandwidth, poor antenna matching, and degraded radiation pattern.

In order to increase bandwidth, in an exemplary embodiment, radiating elements 2101, 2102 are positioned at a given spacing and have a small difference in size. This spacing allows increasing sensibly the bandwidth of the radiating element. In addition, other factors may be change, such as the shapes of radiating elements 2101, 2102 which may differ from each other, or the alignment of radiating elements 2101, 2102. In an exemplary embodiment, each radiating element is optimized to resonate on a specific frequency band, and the combination of the different bands results in a larger bandwidth. This may be a very important characteristic for a receive antenna where more than 20% of bandwidth is required. Furthermore, in an exemplary embodiment, the stacked configuration of radiating elements provides more bandwidth than necessary and hence gives more flexibility in the design of the antenna to meet other design requirements.

In an exemplary embodiment, stacked radiating elements 2103, 2104 are used to increase the radiation of radiating element structure 2100 in the upper direction and reduce the emitted power in the bottom and side direction. In the exemplary embodiment, placing stacked radiating elements 2103, 2104 at a height that pulls the emitted power in the direction of the stack results in a reduction of front-to-back radiation and in an increased directivity. In an exemplary embodiment, the height is optimized by using computer aided simulations and its precision may, for example, be defined within one tenth of lambda. In another embodiment, the shapes of radiating elements 2103, 2104 are designed to achieve the same results. In yet another embodiment, the alignment of radiating elements 2101-2104 is optimized to shape the radiation pattern in a specific form.

Moreover, in an exemplary embodiment the reduction of back radiation is also achieved in part by shaping the coupling slot feed. For example, an H-shaped slot feed allows an equivalent level of coupling between the line and the patch, while limiting the length of the slot, hence limiting resonant effects on the slot and reducing radiation in the backward direction.

In addition to reducing back radiation, in an exemplary embodiment, stacked radiating elements are designed to increase the radiation level toward the main direction of interest and reduce the radiation in unwanted directions. In other words, stacked radiating elements may be configured to reduce unwanted radiation. In an exemplary embodiment, the stacked configuration is configured to minimize, or substantially minimize, the radiation close to the zenith direction and in the backward direction. The radiation is maximized, or substantially maximized, in the forward direction, which is the direction of the main beam. In this way, grating lobes that have the effect of reducing the performance of the antenna are cancelled or substantially reduced.

Figure 27A:
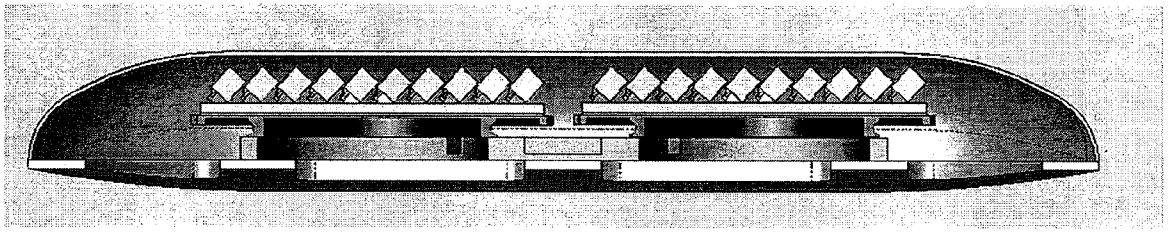
FIG. 27 shows a top view of an exemplary embodiment of a dual aperture inclined array antenna system.
Figure 27B:
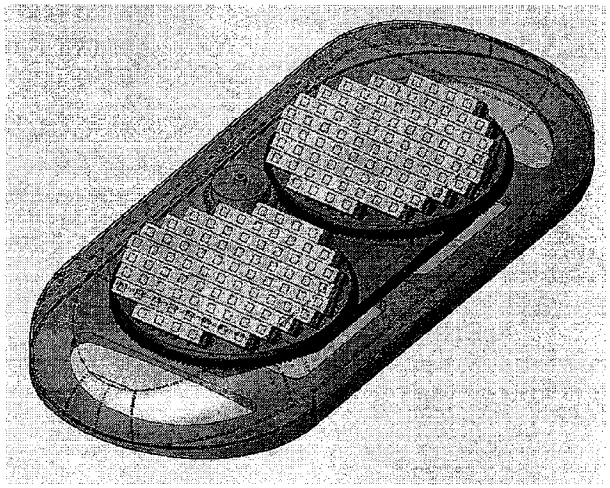

In accordance with an exemplary embodiment and with reference to FIG. 27, a dual aperture inclined array antenna system comprises multiple arrays of radiating element structures. A first aperture comprises radiating element arrays configured for receiving a signal. A second aperture comprises radiating element arrays configured for transmitting a signal. In various other embodiments, both apertures may be configured for only transmitting a signal, only receiving a signal, or transmitting and receiving a signal in the same aperture. In an exemplary embodiment, a linear antenna array comprises multiple radiating elements assembled in a row. The dual aperture inclined array antenna system may be used as a mobile antenna system, capable of scanning low elevations.

In order to scan at low elevation with low profile antenna structures, the inclination of radiating element structures can provide important benefits. Specifically, an array of inclined radiating elements can scan at low elevation with fewer elements than a planar array of radiating elements. One benefit of an inclined array is that in a steerable antenna, less active circuitry is needed in comparison to a planar array. In an exemplary embodiment, no mechanical or electronic scanning is needed to scan at low elevation. In another exemplary embodiment, electronic scanning is implemented to scan at low elevation. In various embodiments, low elevation may include the horizon line, about 0-20 degrees above the horizon line, about 20-30 degrees above the horizon line, or any range within about 0-40 degrees above the horizon line.

Figure 22:
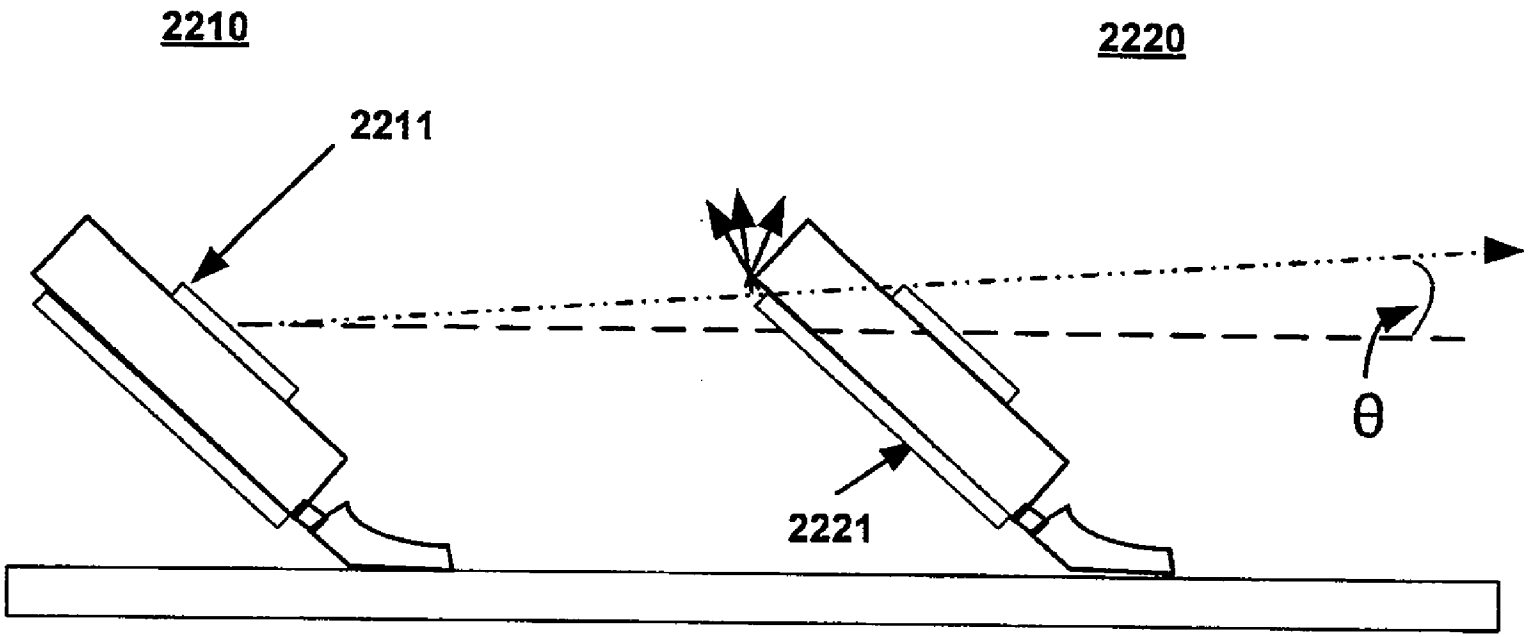
FIG. 22 shows a side view of a typical prior art antenna array layout.

However, one of the drawbacks of a typical inclined array structure is the blockage of radiation caused by radiating element structures in the rows that are in front of the radiating element, as illustrated in FIG. 22. In a typical inclined array structure, the inclined radiating elements are spaced in order to reduce the blockage of a rear radiating element structure 2210 due to a front radiating element structure 2220. One of the main problems of inclined rows array is that rear radiating element structure 2210 is "covered" by a ground plane 2221 of front radiating element structure 2220 when looking at low elevation angles. In other words, in this typical configuration, ground plane 2221 is between a radiating element "patch" 2211 of rear radiating element structure 2210 and a satellite at low elevation. Patch antenna 2211 ability to receive/transmit radiation at low elevation is limited if behind ground plane 2221. The main effect is that the power radiated, or power received, by rear radiating element structure 2210 is partially reflected and scattered by ground plane 2221, therefore a good radiation pattern at low elevation is not achievable in the prior art. Moreover the reflected power tends to radiate in the opposite direction causing a raise in grating lobes and side lobes.

Figure 23:
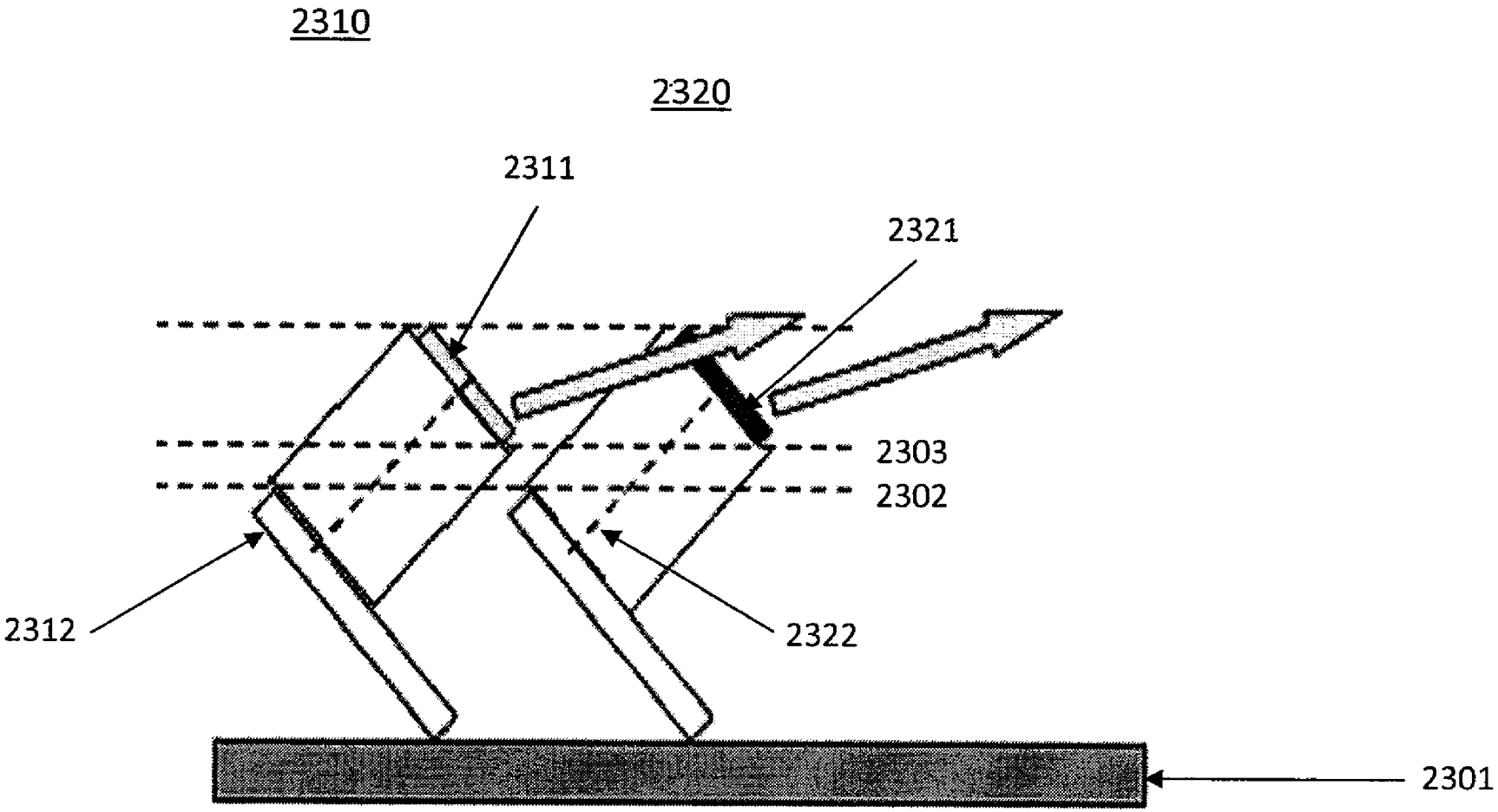
FIG. 23 shows a side view of an exemplary embodiment of an antenna array layout.

In accordance with an exemplary embodiment, a new configuration of radiating elements in an array of inclined elements allows for minimization of the interference of the ground plane and increases the radiation at low elevation. In accordance with an exemplary embodiment and with reference to FIG. 23, a rear radiating element structure 2310 comprises a patch antenna 2311 and a ground plane 2312. Furthermore, a front radiating element structure 2320 is located in front of rear radiating element structure 2310 and also comprises a patch antenna 2321 and a ground plane 2322. The term "front" denotes a direction towards a source satellite, if the inclined radiating elements are facing the satellite. As illustrated by FIG. 23, in an exemplary embodiment, patch antenna 2311 is higher from a mounting surface 2301 in comparison to ground plane 2322. In this configuration, patch antenna 2311 has a "clear view" of the low elevation and is much less affected by reflection and scattering. In other words, patch antenna has increased directivity at low elevation and increased polarization quality due to reduced signal scattering. A clear view allows an increase in antenna performance at low elevations, and minimization of the interference between the different rows. In one embodiment, a clear view is defined as when the bottom edge 2303 of patch antenna 2311 is positioned completely above the top point 2302 of ground plane 2322 of front radiating element structure 2320. In another embodiment, a clear view is when any portion of patch antenna 2311 is positioned above the top point 2302 of ground plane 2322.

In yet another embodiment, patch antenna 2311 has a clear view depending on the minimum elevation angle and the percent clearance horizontally over ground plane 2322 of radiating element structure 2320. In an exemplary embodiment, the minimum elevation angle is a specific angle value in the range of 0-40°, 0-25°, or 0-20°. In an exemplary embodiment, the percent clearance horizontally over ground plane 2322 is a percentage value within at least one of 100% (completely clear), 75-100% clear, 66-100% clear, 50-100% clear, and any range within 50-100% clear. As would be understood by one skilled in the art, various ranges may be considered a "clear view" that provides the benefit of less reflection and scattering affect.

Factors that may affect a "clear view" include the size of patch antenna 2311, the size of ground plane 2322, the angle of inclination, a minimum scanning elevation, the height of patch antenna 2311 relative to ground plane 2312, and the spacing between radiating element structures 2310 and 2320. In an exemplary embodiment, if all these variables are held constant and only the height of patch antenna 2311 relative to ground plane 2322 is increased, the percentage of "clear view" will be increased as much as up to the 100% clear view point. Also, holding all other factors constant, increasing the height of patch antenna 2311 may facilitate lowering the minimum scanning elevation without degradation of performance. The minimum scanning elevation could be any angle within the follow ranges: 0-20°, 20-25°, 25-40° or any suitable minimum scanning elevation.

In accordance with an exemplary embodiment, a radiating element structure is designed according to the desired minimum elevation angle and the desired clear view percentage of the patch antenna at the minimum elevation angle. In other words, the radiating element structure may be designed such that the patch antenna has an unimpeded exposure to the desired minimum elevation angle.

Figure 24:
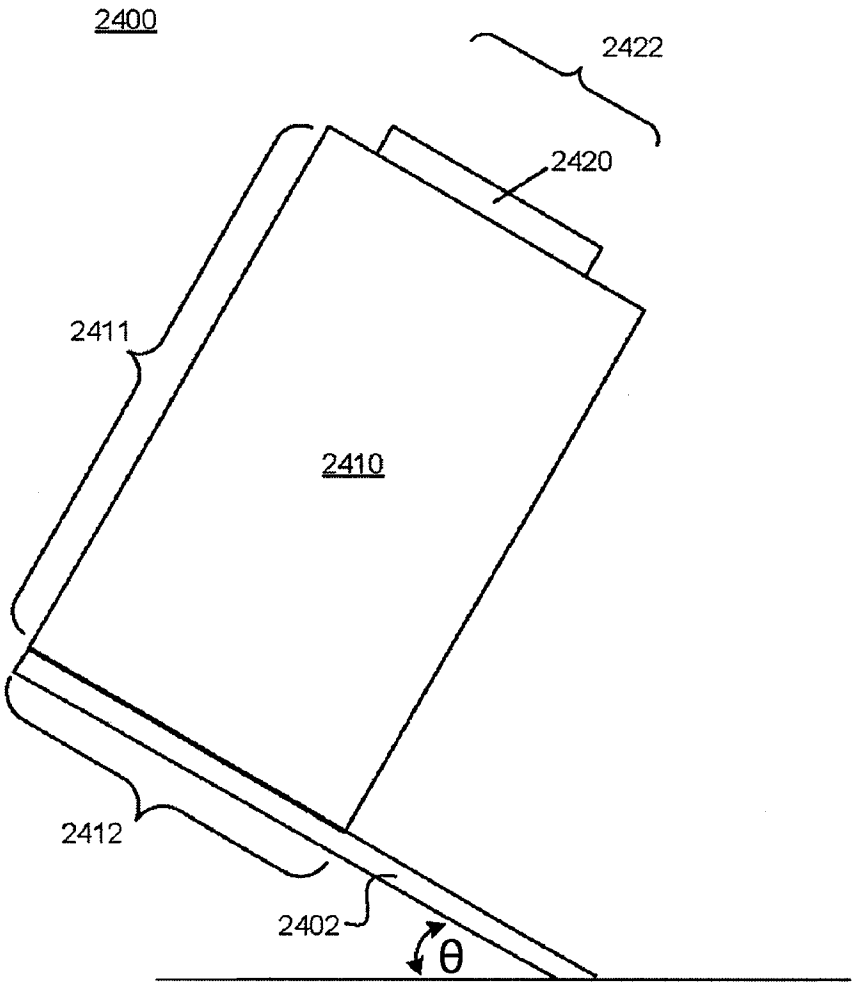
FIG. 24 shows a side view of an exemplary radiating element structure and associated dimensions.

For example, the radiating element structure may be designed such that an entire patch antenna is not covered by a ground plane at the 0° horizon line. In an exemplary embodiment, and with reference to FIG. 24, the dimensions of a radiating element structure 2400 are designed to result in a bottom point of a patch antenna 2420 being uncovered by the top point of a ground plane 2402 in the next row of radiating element structures. In other words, in an exemplary embodiment patch antenna 2420 is designed to have an entirely clear view of the horizon line. In the exemplary embodiment, radiating element structure 2400 comprises a dielectric material 2410 connected between patch antenna 2420 and ground plane 2402. Specifically, the dimensions of dielectric material 2410 can be determined based on the size of patch antenna 2420 and an angle θ, which is the angle of a mounting surface 2401 to ground plane 2402. Dielectric material 2410 has a dielectric material height 2411 and a dielectric material width 2412. Furthermore, patch antenna 2420 has a patch antenna width 2422. In accordance with the exemplary embodiment, dielectric material 2410 is designed with a minimum height 2411 that is greater than or equal to ½*tan(angle θ)*(patch width 2422+dielectric material width 2412). This formula is based in part on assuming that patch antenna 2420 is centered on dielectric material 2410, and that dielectric material 2410 is located at the top of ground plane 2402. Other methods may also be employed to determine a suitable relationship between these factors for designing the radiating element structure to have a desired amount of clear view.

Figure 25:
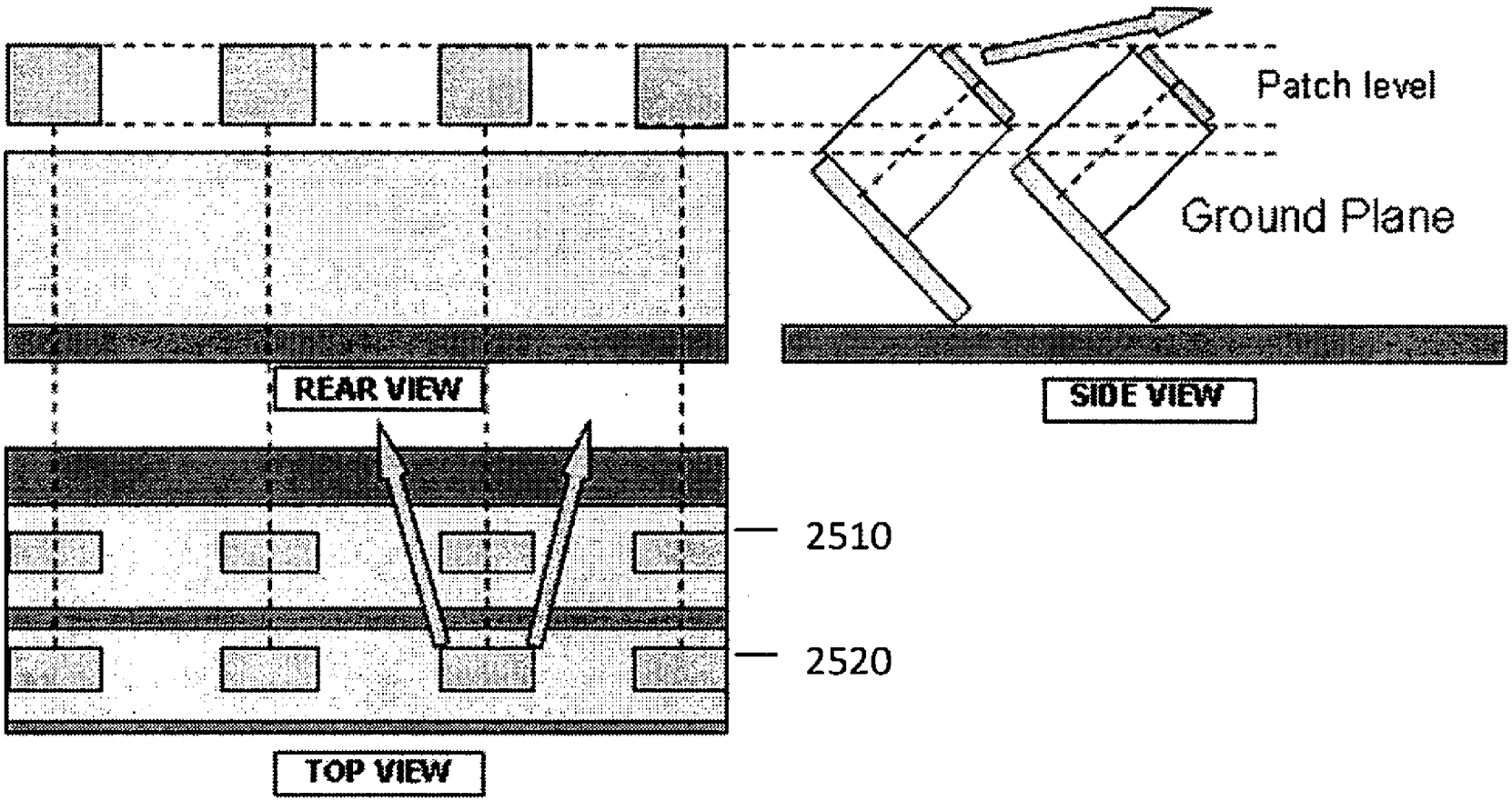
FIG. 25 shows a top view of an exemplary embodiment of an antenna array layout with aligned radiating element structures.

The layout of radiating element structures in an antenna system also has an impact on the radiation patterns of the elements. For example, in one exemplary embodiment, and with reference to FIG. 25, a first row of radiating element structures 2510 may be positioned directly in front of a second row of radiating element structures 2520, such that the patch antennas appear "blocked" by the other patch antennas in front. This effect exists indeed but is weaker than the blockage of RF signals by a ground plane because the patch antennas are all resonant at the desired frequency and tend to re-radiate the received power instead to reflect it as the ground plane would.

Figure 26:
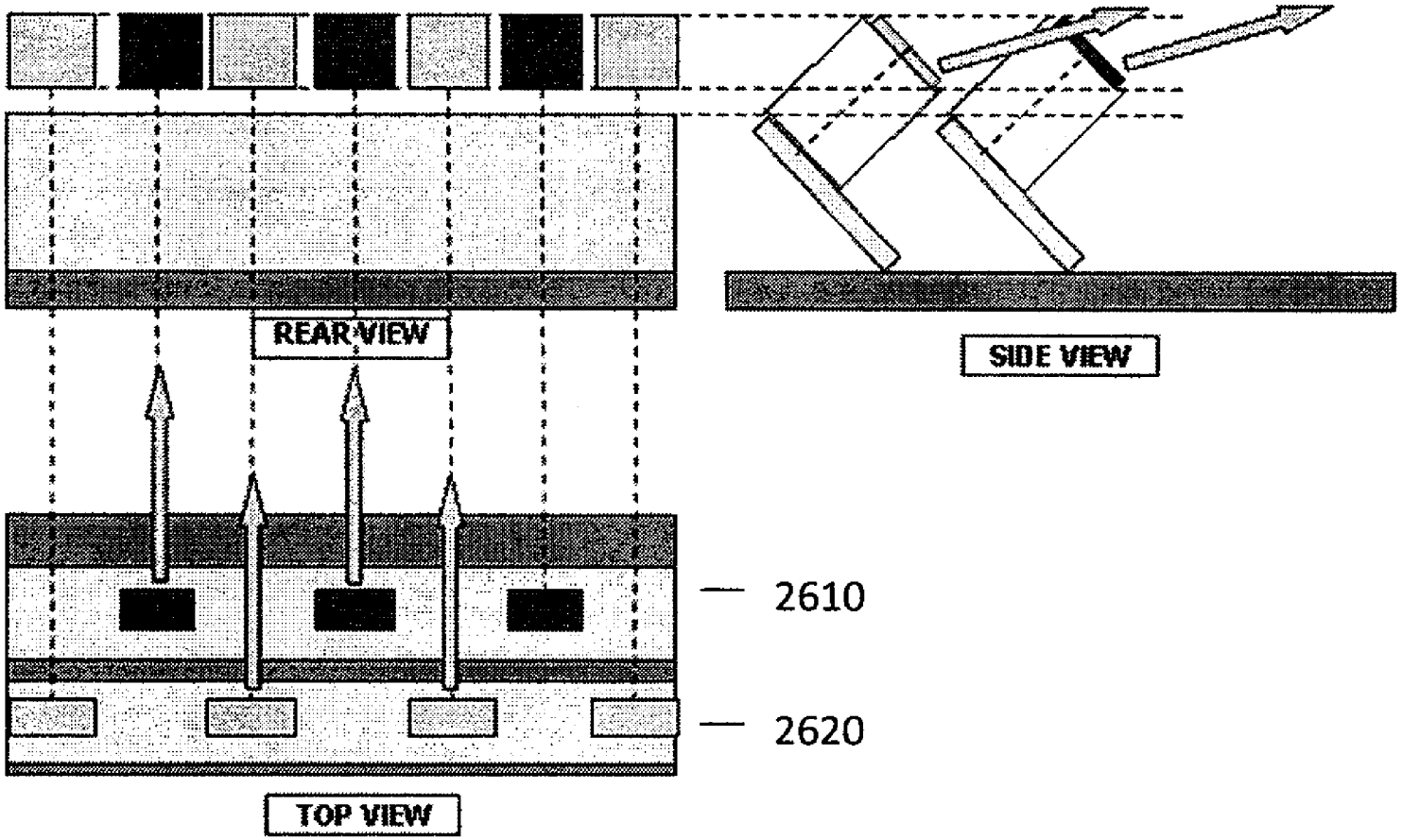
FIG. 26 shows a top view of another exemplary embodiment of an antenna array layout with interleaved radiating element structures.

In another exemplary embodiment, and with reference to FIG. 26, a further optimized antenna system configuration comprises a first row of radiating element structures 2610 interleaved with respect to a second row of radiating element structures 2620. For example, in one embodiment, each row is laterally displaced with respect to the next row (for example, displaced by the half of the inter-element distance). This configuration further minimizes the interference between the elements. In another embodiment, an inclined array of patch antennas is staggered such that the patch antennas of the inclined array are not directly located in line with the nearest array of patch antennas. Other aspects may be used to minimize interfere. For example, in an exemplary embodiment, first row of radiating element structures 2610 is configured to receive a signal, and second row of radiating element structures 2620 is configured to transmit a signal.

In accordance with an exemplary embodiment, the heights of radiating element structures, or components within the radiating element structures, may vary from row to row. In a first embodiment, the sizes of the ground planes vary from row to row. For example, the ground plane size may increase from front to back, decrease from front to back or alternate from row to row. In this first embodiment, the overall heights of the radiating element structures remain the same. Though the ground plane sizes may vary, the radiating element structures remain configured for increased directivity of the patch antenna to a low elevation angle and less signal interference due to signal scattering. In a second embodiment, the overall heights of the radiating element structures vary, increasing from front to back. In this second embodiment, an increase in the size of radiating element structures, such as the dielectric material, accounts for the increased overall heights. In a third embodiment, the sizes of the radiating element structures are uniform, but the radiating element structures are mounted at different heights. For example, spacers may be used to increase the overall heights, from front to back. Similar to increasing the size of radiating element structures, a patch antenna uncovered by a ground plane has more directivity and less interference. In a fourth embodiment, the radiating element structures are mounted on a tilted surface, resulting in an increase in the overall heights of radiating element structures from front to back. A tilted surface results in a radiating element structure being higher in comparison of another radiating element structure located at a lower point of the tilted surface. In a fifth embodiment, the radiating element structures in different rows are spaced in an up and down fashion in alternating rows such that either the upper edge or lower edge of a patch antenna is uncovered by the row in front. In a sixth embodiment, a combination of two or more of the first five embodiments is applied to achieve radiating element structures with varying heights and/or varying ground plane sizes.

In accordance with another exemplary embodiment, radiating elements in a first row have a different shape than radiating elements in a second row. The radiating elements are shaped to reduce interference with the radiating elements in a nearby row. For example, a first row may comprise radiating elements having a "T-shape", and a second row may comprise radiating elements having a "U-shape". In an exemplary embodiment, aligning the first and second rows results in lower signal interference between the rows.

In another exemplary embodiment, a radiating element is rotated relative to another radiating element. The two radiating elements are inline with one another and directed to the front of an inclined array antenna. For example, a first row may comprise triangle-shaped radiating elements in an upright orientation (▲), and a second row may comprise triangle-shaped radiating elements rotated 180°, resulting in a downward orientation (▼). Furthermore, other shaped radiating elements may be rotated, and may be rotated at various other rotations than 180°.

In an exemplary embodiment, the element spacing from an electrical viewpoint is in the range of approximately ½-2 wavelength. In other exemplary embodiments the element spacing may be approximately 0-1 wavelength or even overlapping. Element spacing here refers to the distance between the projection of the patches of a front row and a row behind the front row. In an exemplary embodiment, a staggered layout provides improved radiation patterns and lower side lobes in comparison to a symmetrical alignment. Moreover, the alignment of the radiating elements may be any non-uniform layout or other suitable pattern to improve radiation patterns and lower side lobes.

In addition, the interleaving can be described from an antenna array standpoint. In an exemplary embodiment, the spacing of various patch antennas are designed based in part on the position of patch antennas located on other antenna arrays.

Figure 1:
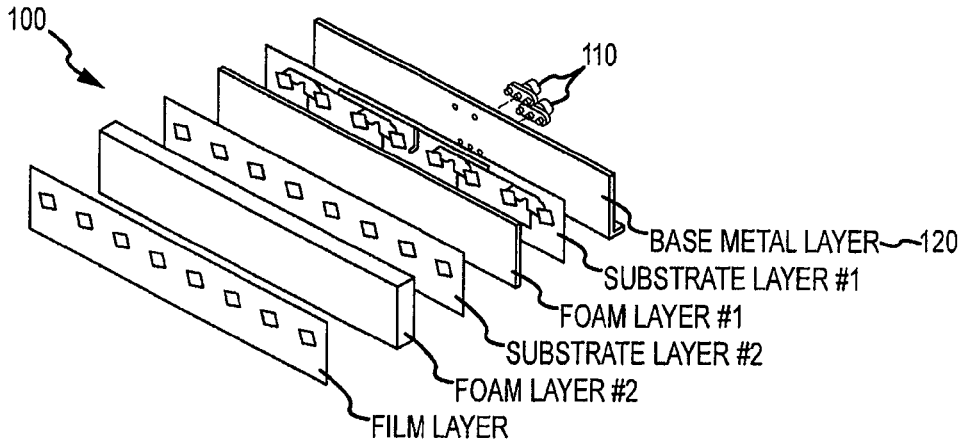
FIG. 1 shows an exploded view of a prior art example of an antenna module with a coaxial RF connector.

With reference now to FIG. 1, a prior art antenna module 100 includes a coaxial radio frequency (RF) connector 110 and a base metal layer 120. Some examples of a common coaxial RF connector 110 used in prior art systems include an SMA (subminiature version A) connector, a Molex SSMCX, and a Huber Suhner MMBX. The use of such connections result in a complex assembly because the connectors must be hand-tightened and there are a large number of connectors in a prior art antenna using module 100. The connections also may result in an overall taller antenna module due to the size of the connectors and space needed to install them.

Figure 2:
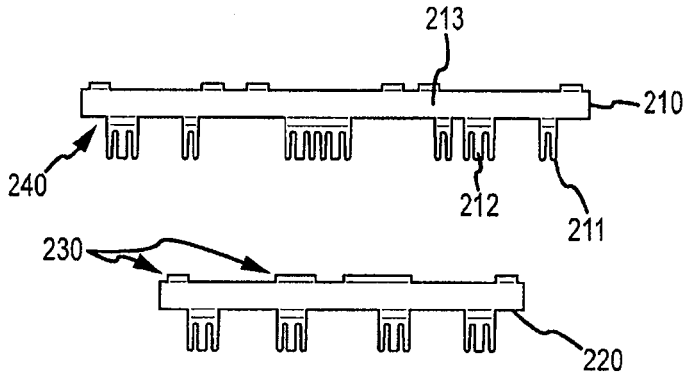
FIG. 2 shows two examples of a bar with leads connector.

In accordance with an exemplary embodiment of the present invention, and with reference to FIG. 2, various exemplary bar with leads connectors are discussed. A bar with leads connector may also be described as a lead frame. For example, bar with leads connector 210, 220 may comprise a bar 213 and two or more leads 211, 212. Furthermore, bar with leads connector 210, 220 may include a break-away point 240 which is, for example, a point that is scored or etched to provide a suitable point of separation of the bar from the leads.

In an exemplary embodiment, bar 213 is flat and configured to provide a flat area for vacuum pick-up implemented by typical pick-and-place machines. Apart from providing a suitable flat area for the pick and place machine, in another embodiment, the bar may be configured to shift the center gravity of the bar with leads connector 210, 220 to the flat area. In order to provide a stable place to pick up the bar with leads connector, the bar with leads connector may be designed, for example, so that the center of gravity is not over the leads or edge.

In another embodiment, bar 213 also has feet 230, allowing for bar with leads connector 210, 220 to be installed during assembly over other previously installed components. In other words, electrical components and/or printed circuit lines may be present on a printed circuit board (PCB) when bar with leads connector 210, 220 is attached. In an exemplary embodiment, bar 213 angles up from the PCB, creating space between bar 213 and the PCB. In the exemplary embodiment, feet 230 extend from bar 213 and provide structural support for the space between bar 213 and the PCB. By providing spacing using feet 230, the bar with leads does not interfere, and possibly damage, the other components on the PCB.

Furthermore, there are many types of leads. Leads 211 may, for example, be direct current lead connections. Leads 212 may, in another example, be RF lead connections. In an exemplary embodiment, the RF lead connections comprise a ground-signal-ground design of leads. In accordance with an exemplary embodiment, bar with leads connector 210, 220 may be configured for use on transmit or receive antennas. Thus, for example, bar with leads connector 210 may be configured to attach to a printed circuit board for a receive antenna. In another example, bar with leads connector 220 may be configured to attach to a printed circuit board for a transmit antenna. Furthermore, in an exemplary embodiment, bar with leads connector 210, 220 is configured to attach to a printed circuit board for a transceiver antenna.

In an exemplary embodiment, bar with leads connector 210, 220 is designed with specific spacing of leads 211, 212 such that the leads align with lead pads on the surfaces to which the leads are attached. Additionally, in an exemplary embodiment, bar with leads connector 210, 220 may be any structure that holds two or more leads for attachment to other structures.

Furthermore, in an exemplary embodiment, leads 211, 212 are angled or bent. In one embodiment, the leads of bar with leads connector 210, 220 are bent to a desired angle to allow connection of an inclined surface and another surface. The inclined surface, for example, is an antenna module and the other is a mounting surface. In another exemplary embodiment, a lead comprises a first end and a second end. The first end of the lead is in one plane and the second end of the lead in is a different plane. In an exemplary embodiment, the leads are bent at an angle in the range of 2 to 90 degrees between the first end and the second end of the lead. In another exemplary embodiment, the leads are bent at any suitable angle for connecting two surfaces as would be known to one skilled in the art. Also, the lead may be bent at any point along the lead, for example it may be bent in the middle or along a third of the lead length.

In one embodiment, bar with leads connector 210, 220 is made of copper. In another embodiment, bar with leads connector 210, 220 may be made of at least one of BeCu and steel. In yet another embodiment, the leads are plated with materials that are conducive to soldering, such as, for example, tin, silver, gold, or nickel. Moreover, bar with leads connector 210, 220 may be made of, or plated with, any suitable material as would be known to one skilled in the art.

Additionally, in an exemplary embodiment, RF lead connections provide a connection with a broad bandwidth and a low loss. In an exemplary embodiment, broad bandwidth is bandwidth with a range of DC to 15 GHz. In another embodiment, broad bandwidth is bandwidth with a range of DC to 80 GHz or any suitable range in between. Furthermore, in an exemplary embodiment, low loss is loss in the range of 0.01 dB to 1.5 dB as the loss is a function of frequency. Additionally, there may be other suitable ranges of low loss as is known in the art. The RF leads may provide such a connection for at least one of the X band, the Ku band, the K band, the Ka band, and the Q band. Moreover, the RF may provide such a connection for other suitable bands as would be known to one skilled in the art.

Figure 3:
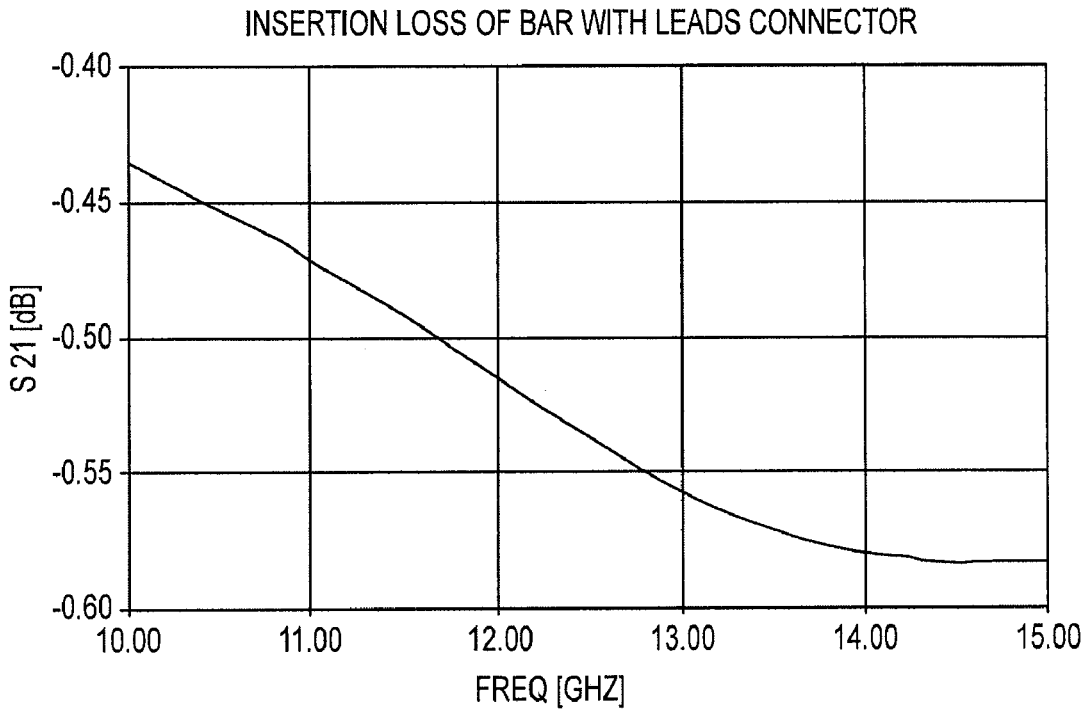
FIG. 3 shows an example graph depicting insertion loss.
Figure 4:
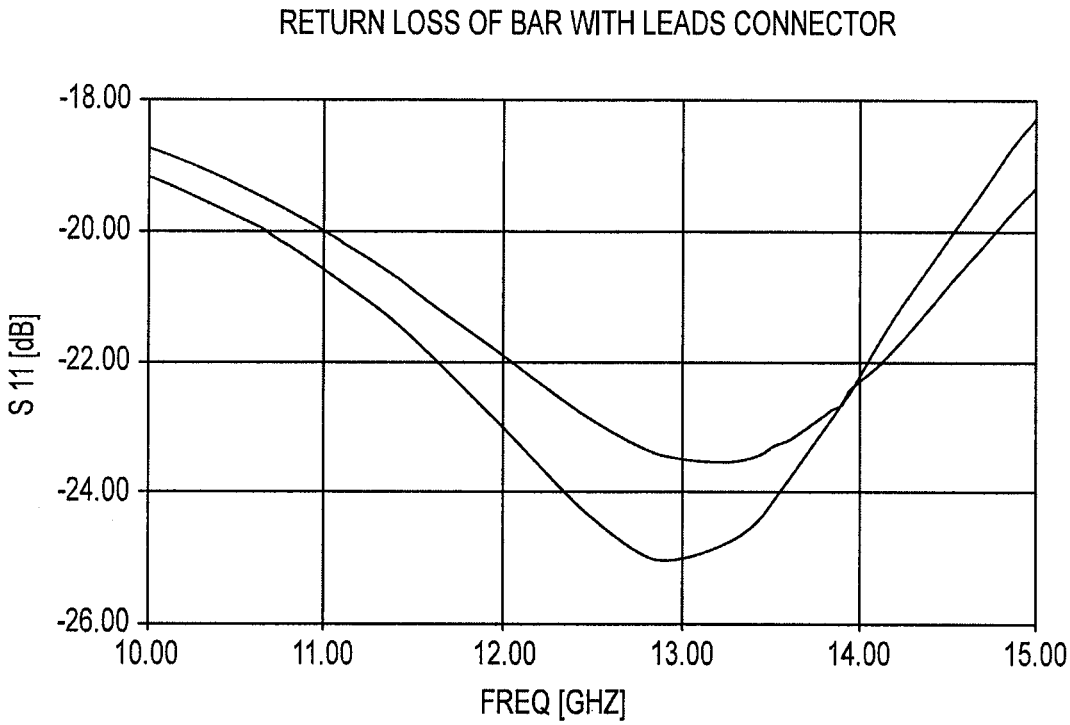
FIG. 4 shows an exemplary graph depicting return loss.

In addition, in an exemplary embodiment and with reference to FIG. 3, the RF lead connections provide a low pass response, e.g., filtering. In an exemplary embodiment, the insertion loss is less than 0.6 dB up to about 15 GHz. Furthermore, in an exemplary embodiment and with reference to FIG. 4, the return loss of the interface is more than about 18 dB up to 15 GHz and better than about 20 dB for the range of 11-14.5 GHz.

Figure 5:
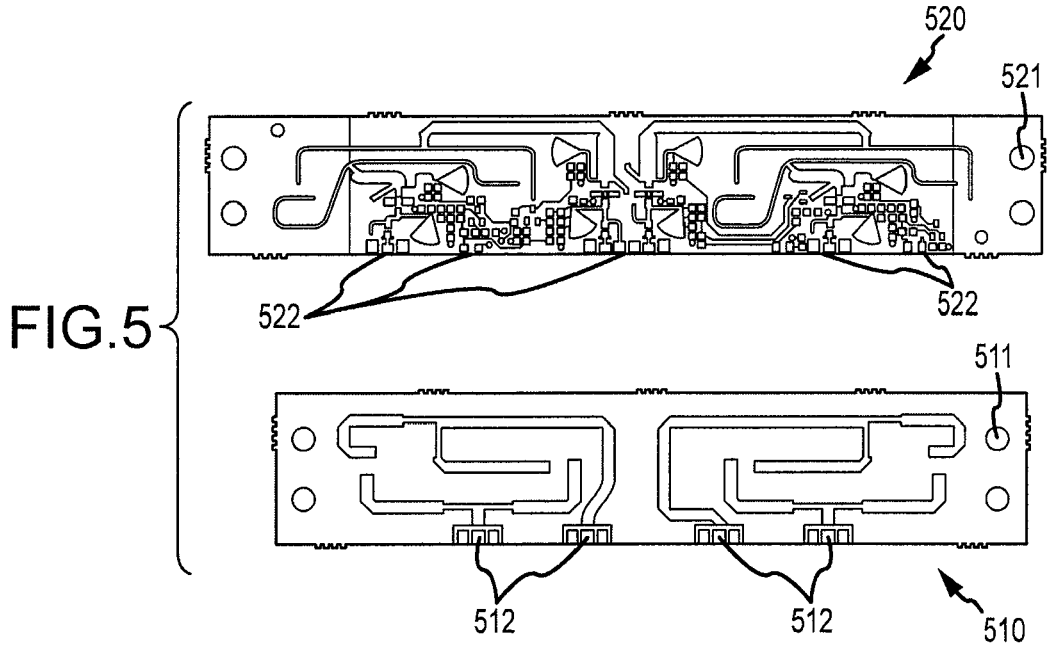
FIG. 5 shows two examples of a printed circuit board.

In an exemplary embodiment, and with reference to FIG. 5, various printed circuit boards (PCB) are discussed. In one embodiment, a PCB 510, 520 comprises tooling holes 511, 521 and lead pads 512, 522. Tooling holes may align PCB 510, 520 to help test or assemble fixtures. Tooling holes may also align PCB 510, 520 to other sub-assemblies or components. Furthermore, in an exemplary embodiment, PCB 510 is a transmit PCB and PCB 520 is a receive PCB. As a transmit PCB, PCB 510 may comprise matching structures and bias feeds. As a receive PCB, PCB 520 may further comprise at least one resistor, at least one capacitor, and/or a low noise amplifier (LNA) transistor(s). In general, PCB 510, 520 may be any laminate or substrate that carries signals and holds components.

Figure 6:
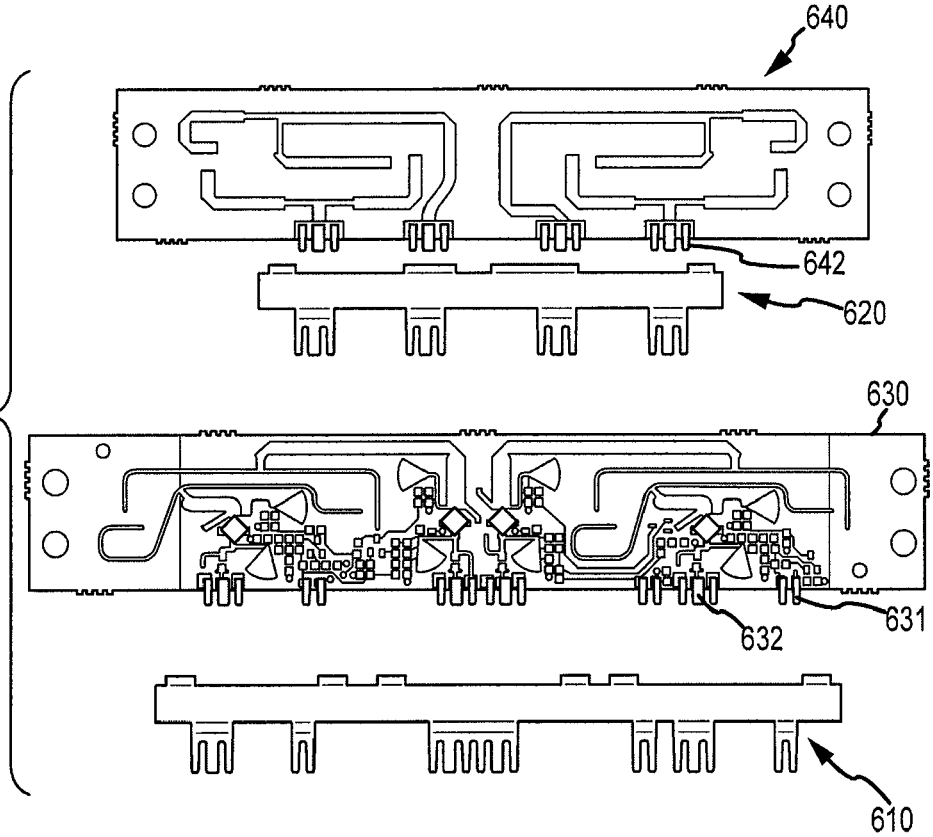
FIG. 6 shows two examples of a bar with leads connector before attachment and two circuit boards with leads attached.

In an exemplary embodiment, and with reference to FIG. 6, an exemplary PCB 630 comprises leads 631, 632. Leads 631, 632 are attached using a bar with leads such as bar with leads connector 610. Another exemplary PCB 640 comprises leads 642. The leads 642 were attached using a bar with leads, such as bar with leads connector 620. In an exemplary embodiment, lead 631 is a direct current lead. In another exemplary embodiment, leads 632, 642 are RF leads.

Figure 7:
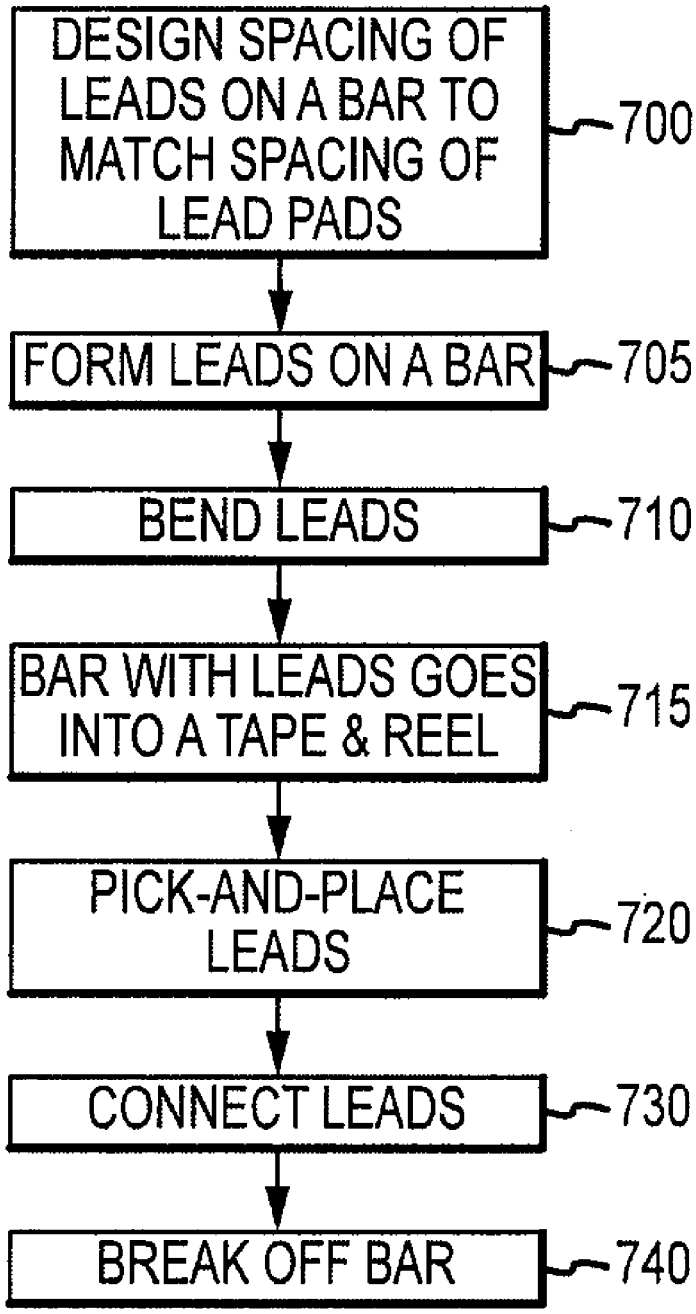
FIG. 7 shows a flowchart of a method for attaching multiple leads to a PCB using a bar with leads connector.

In accordance with an exemplary method, and with reference to FIG. 7, a bar with leads connector is attached to a PCB. The exemplary method may comprise designing the spacing of leads of the bar with leads connector such that the spacing of the leads matches the spacing of lead pads on the PCB (Step 700). In accordance with various exemplary embodiments, leads and feet are cut, etched, and/or formed on a bar (Step 705). The leads may be of any suitable length and spaced apart as desired. The leads of the bar with leads connector are bent to a desired angle (step 710). In another exemplary embodiment, the feet may be formed in the same step. The bend of the leads may be configured to allow connection of an antenna module to another surface where the antenna module is inclined relative to the other surface. In an exemplary embodiment, the leads are bent at an angle in the range of 2 to 90 degrees from the bar. In an exemplary embodiment, leads may be bent, formed, or stamped to the desired angle by a machine. In another exemplary embodiment, the bar with leads may then be installed into a tape and reel (Step 715). The tape and reel provides another manner of machine handling the bar with leads to feed a pick-and-place machine. Then the bar with leads connector is placed into correct position on the PCB such that the leads are aligned with corresponding lead pads (Step 720). This placement may be done, for example, by a machine in a pick-and-place manner. An exemplary method may comprise any combination of the described steps.

In an exemplary embodiment, a machine picks and places the bar with leads by suction or a gripping mechanism, using the flat surface of the bar with leads connector. Once the bar with leads connector is correctly positioned, the leads are connected to the PCB (Step 730), which may occur through various known techniques. In an exemplary embodiment, bar with leads connector 610 is attached to PCB 630 through reflow solder technique. The specifics of reflow solder technique are known and may not be discussed herein. In another embodiment, the leads of the bar with leads connector are attached to the PCB by an epoxy attachment or through any other suitable method now known or hereinafter devised. For example, a machine may dispense conductive epoxy on the PCB pads prior to placement of the bar with leads connector. In this example, the epoxy cures to attach the leads to the PCB. After the bar with leads connector is connected to the PCB, the bar portion of the bar with leads connector is broken off (Step 740), leaving just the leads attached to the PCB. The bar may be broken off or detached either manually or with a machine, using any bending, snapping, cutting, laser or other suitable method.

Figure 8:
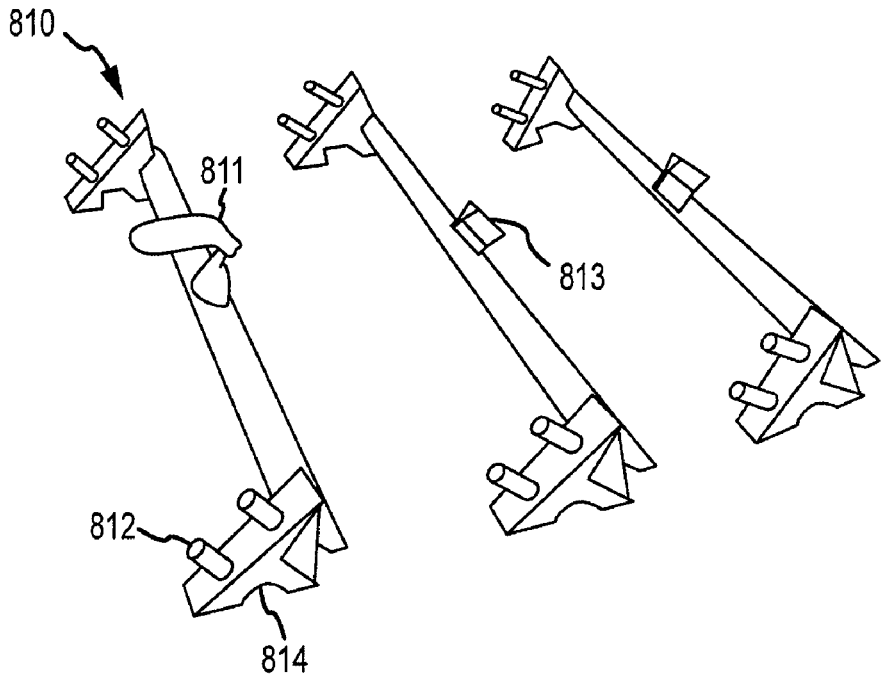
FIG. 8 shows three examples of support brackets, including an example of a support bracket with an exemplary pick-up tab.

With reference now to FIG. 8, an exemplary support bracket 810 is described. In one embodiment, support bracket 810 comprises a pick-up tab 811. In another embodiment, support bracket 810 further comprises tooling pins 812, an alignment tab 813, and alignment pins under feet 814.

In an exemplary embodiment, support bracket 810 is plastic. A plastic support bracket may be molded into a desired shape, and provides a low cost and manufacturability method of supporting the PCB at any angle between 5-90 degrees. Furthermore, support bracket 810 may be made of other light weight materials such as zinc, magnesium, aluminum, and/or ceramic. Moreover, support bracket 810 may comprise any other suitable material as would be known to one skilled in the art.

In an exemplary embodiment, support bracket 810 defines the angle of a radiating element in an antenna aperture. In one embodiment, support bracket 810 is configured to support a radiating element at an angle in the range of 30-60 degrees. In another embodiment, support bracket 810 is configured to support a radiating element at an angle of about 45 degrees. Moreover, support bracket 810 may be configured to support a radiating element at any angle suitable for optimal performance of an antenna.

Pick-up tab 811 may be used to move support bracket 810. For example, a machine may clutch or suction onto pick-up tab 811 in order to place support bracket 810 into a desired location. This may be accomplished, for example, by a pick-and-place machine. Moreover, additional techniques to move support bracket 810 are contemplated as would be known to one skilled in the art.

In one embodiment, tooling pins 812 are configured to align with holes in various antenna module components, such as a PCB. Tooling pins 812 hold and stack the various antenna module components in place. In one embodiment, an antenna module is machine assembled for attaching a support bracket and the PCB to a steering card prior to attaching a foam radiating element to the support bracket. This is due in part to the heat from reflow soldering of components which might otherwise result in potential damage to a foam component. In another exemplary embodiment, the components of an antenna module may be assembled in any suitable order. This may involve hand assembly and/or the use of heat in such a manner as to not result in any substantial impact on any component.

Furthermore, in an exemplary embodiment, alignment pins under feet 814 are protruding shapes along the bottom of support bracket 810. In another embodiment, alignment pins under feet 814 are metal plated or at least have metal deposits on the bottom of the feet. Alignment pins under feet 814 may assist in guiding support bracket 810 into a correct placement on another surface when, for example, the other surface comprises matching concave areas or placement holes. The alignment pins under feet 814 may be configured to provide additional structural support required in COTM applications. When alignment pins under feet 814 are metal plated, support bracket 810 may become a surface mount component similar to other surface mount components. Furthermore, in an exemplary embodiment, support bracket 810 is self-aligning. When the super component subarray is designed to be light weight, the surface tension of the solder during surface mount reflow may facilitate centering the sub-array super component on the PCB mounting pads. This provides very accurate positioning of the sub-array super component on the steering card. Accurate positioning of the sub-array components helps to facilitate the optimal performance of the antenna.

Figure 9:
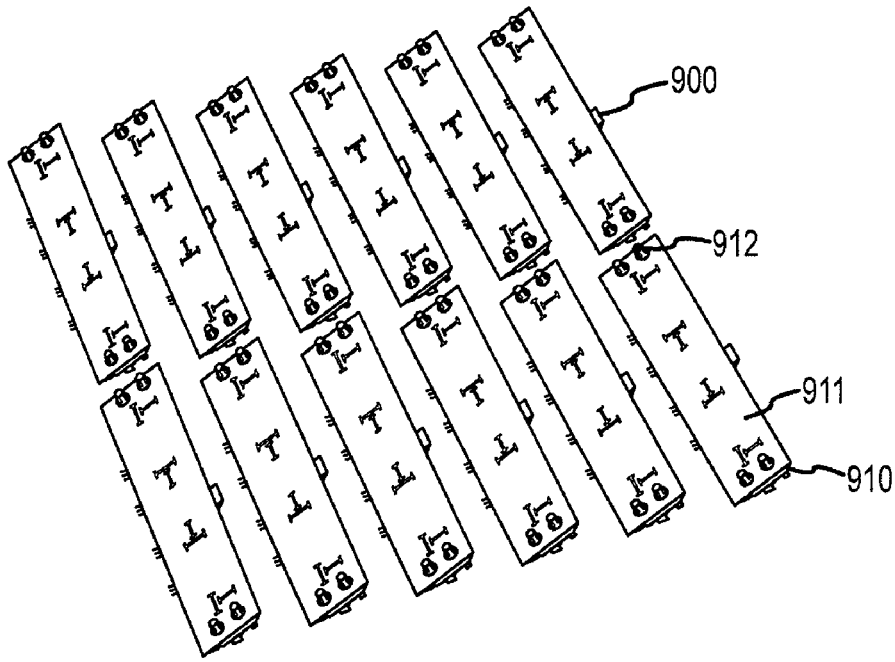
FIG. 9 shows an example of multiple antenna modules.

In accordance with an exemplary embodiment, and with reference to FIG. 9, a partially assembled antenna module 900 may include a support bracket 910 and a PCB 911 connected to support bracket 910 via tooling pins 912.

Figure 10:
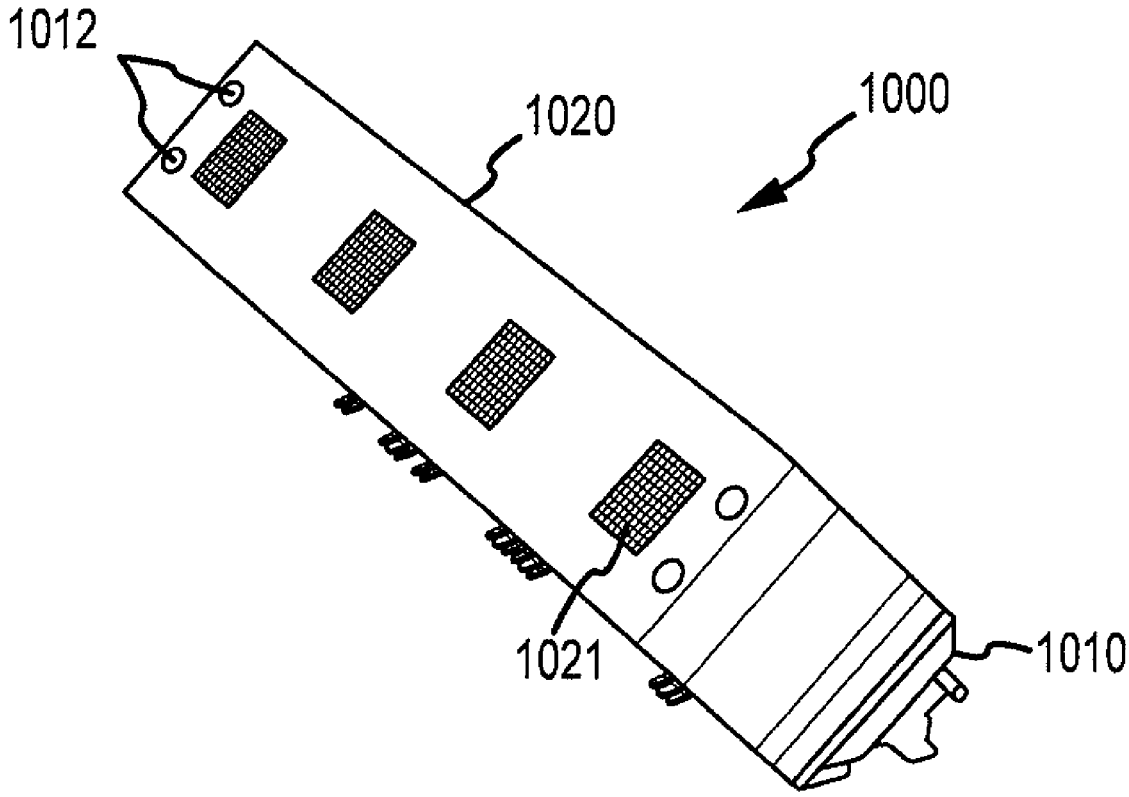
FIG. 10 shows an example of an antenna module.

Furthermore, in an exemplary embodiment, and with reference to FIG. 10, an assembled antenna module 1000 may comprise a support bracket 1010, a foam component 1020, and at least one parasitic patch 1021 connected together via tooling pins 1012. In other embodiments, foam component 1020 may be any other low loss laminate with a low loss tangent. In an exemplary embodiment, parasitic patches 1021 form the desired radiation pattern. Furthermore, foam component 1020 includes holes aligned for tooling pins 1012.

Figure 11:
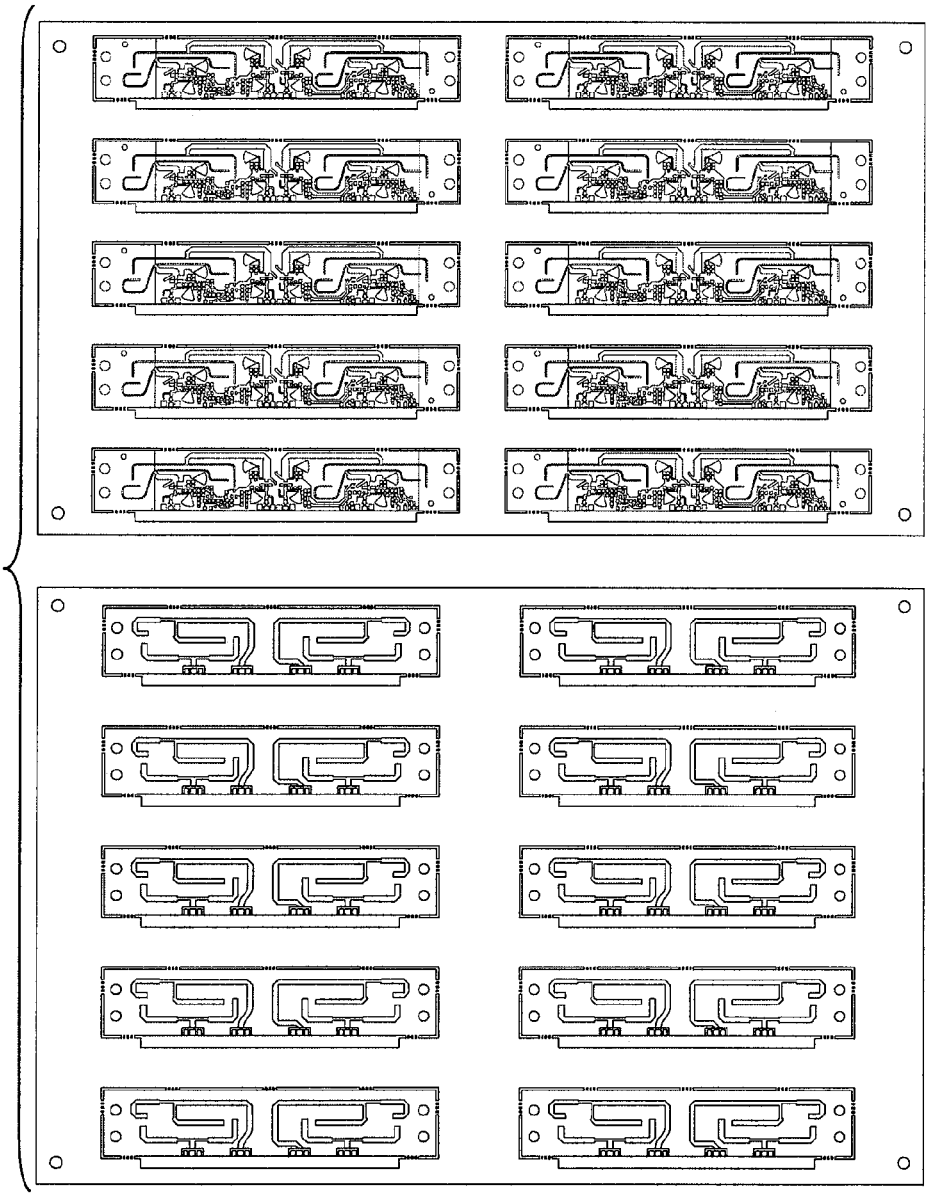
FIG. 11 shows two examples of a circuit board panel.

With reference to FIG. 11, an exemplary method of assembly includes manufacturing various components in a panel. In other words, multiple antenna modules may be formed on a single panel. In an exemplary embodiment, a matching structure, ground vias, and/or bias feed are printed onto a circuit board. In addition, other structures may be printed on a circuit board as would be known to one skilled in the art. In one embodiment, the PCBs may be separated from the panel and assembly as an individual PCB. In another embodiment, the PCBs are also fully or partially assembled and tested in panel form when attaching the leads, which may be done by machine or by hand. An exemplary method of attaching the leads to a PCB is further discussed with reference to FIG. 7. Additionally, other discrete components may be attached to the antenna module while in panel form. The individual PCB's may then be separated from the panel, after full or partial assembly of the sub-array super component.

Figure 12:
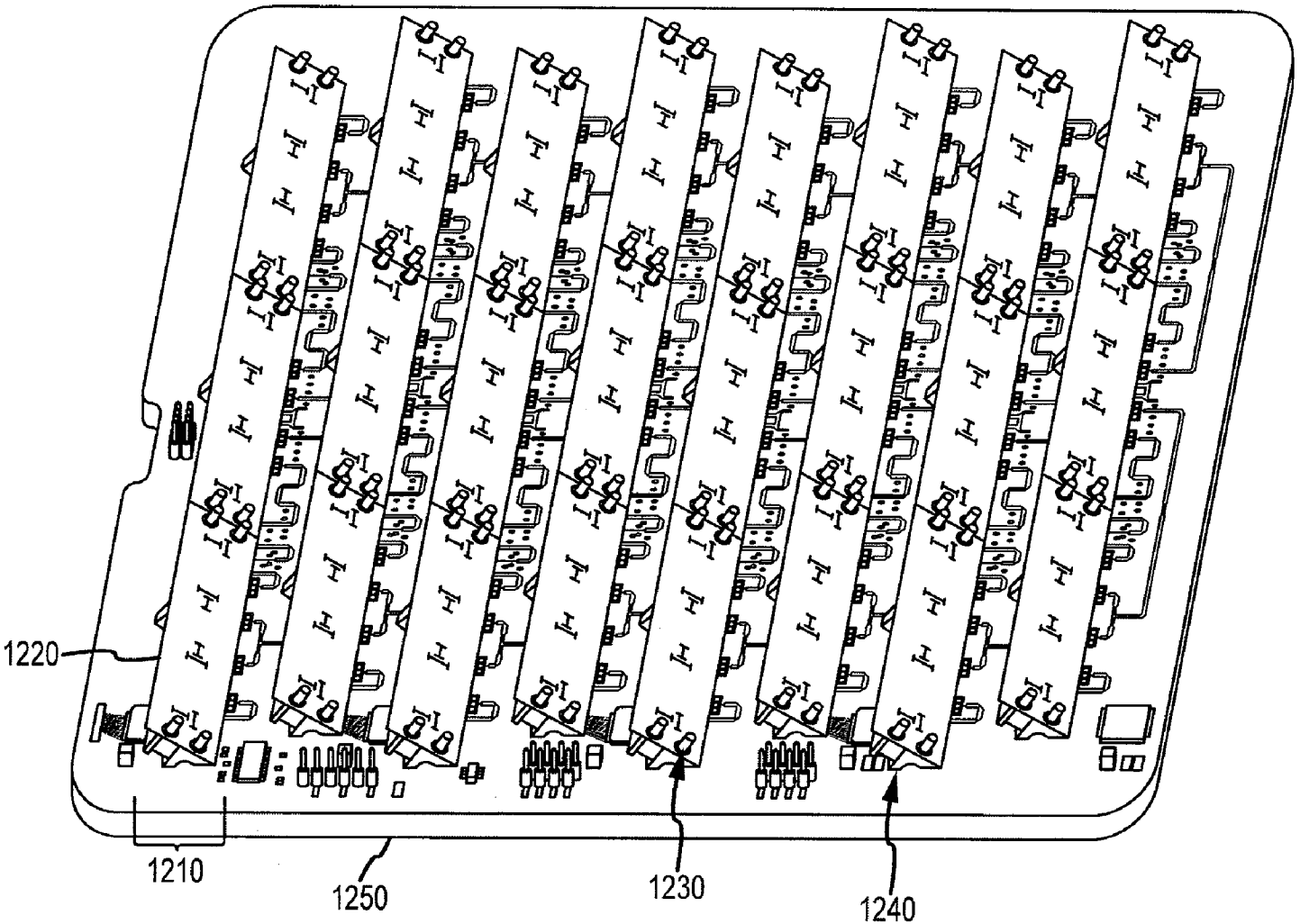
FIG. 12 shows a side view of a hybrid phased array antenna constructed with super components partially assembled.

In accordance with an exemplary embodiment, and with reference to FIG. 12, an array of super components 1210 are designed and attached to a mounting plate 1250. In an exemplary embodiment, a super component includes a PCB 1220 connected to a support bracket 1240. PCB 1220 may be connected to support bracket 1240 via tooling pins 1230. In an exemplary embodiment, various scalable designs are assembled from super components without redesigning the sub-array. As shown in FIG. 12, twenty-four super components 1210 are arranged on mounting plate 1250. Other arrangements may be designed using super components as a building block, invoking the benefits of scalable design.

Figure 13:
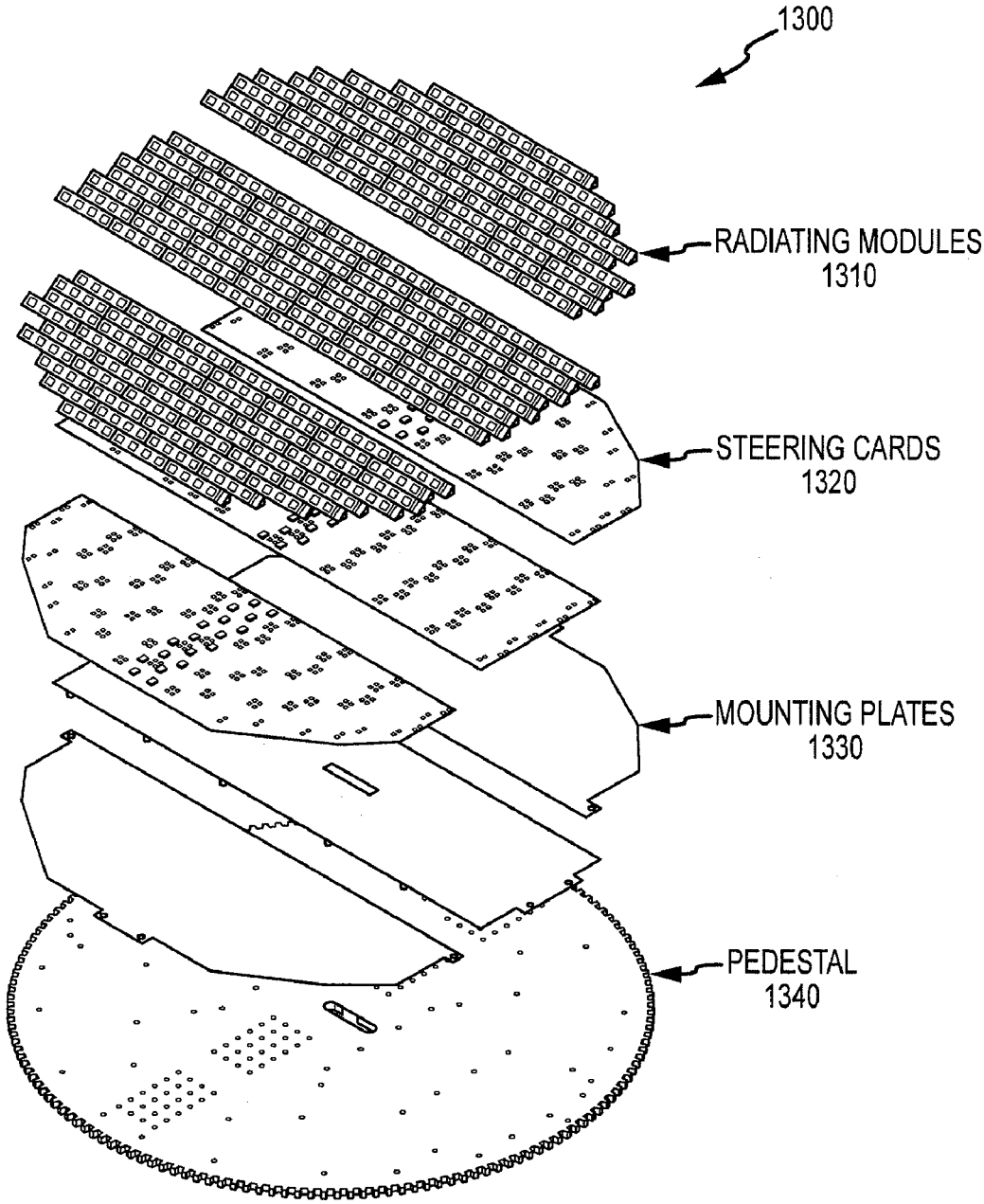
FIG. 13 shows an exploded view of an example of an antenna aperture.

Furthermore, in an exemplary embodiment, and with reference to FIG. 13, an RF antenna aperture 1300 comprises radiating modules 1310, a steering card 1320, a mounting plate 1330, and a pedestal 1340. In one embodiment, aperture 1300 includes steering card 1320 and/or mounting plate 1330 formed by multiple pieces.

An exemplary embodiment of a steering card 1320 includes an elevation beam forming network, an azimuth beam forming network to perform at least part of the azimuth network, and at least one phase shifter. In an exemplary embodiment, the beam forming network components are splitters. Additionally, steering card 1320 may also include an amplifier, such as a power amplifier for a transmit steering card and a low noise amplifier for a receive steering card.

In an exemplary embodiment, RF antenna aperture 1300 further comprises mounting plate 1330. Mounting plate 1330 provides support structure and may also function to dissipate and spread heat from amplifiers. In addition, mounting plate 1330 provides a clean interface to connect (e.g., bolt, fasten, adhere) to pedestal 1340.

In an exemplary embodiment, pedestal 1340 comprises an edge with teeth to match with gears so that pedestal 1340 may be mechanically rotated by a motor. In another embodiment, pedestal 1340 and mounting plate 1330 are integrated into a single piece.

Figure 14:
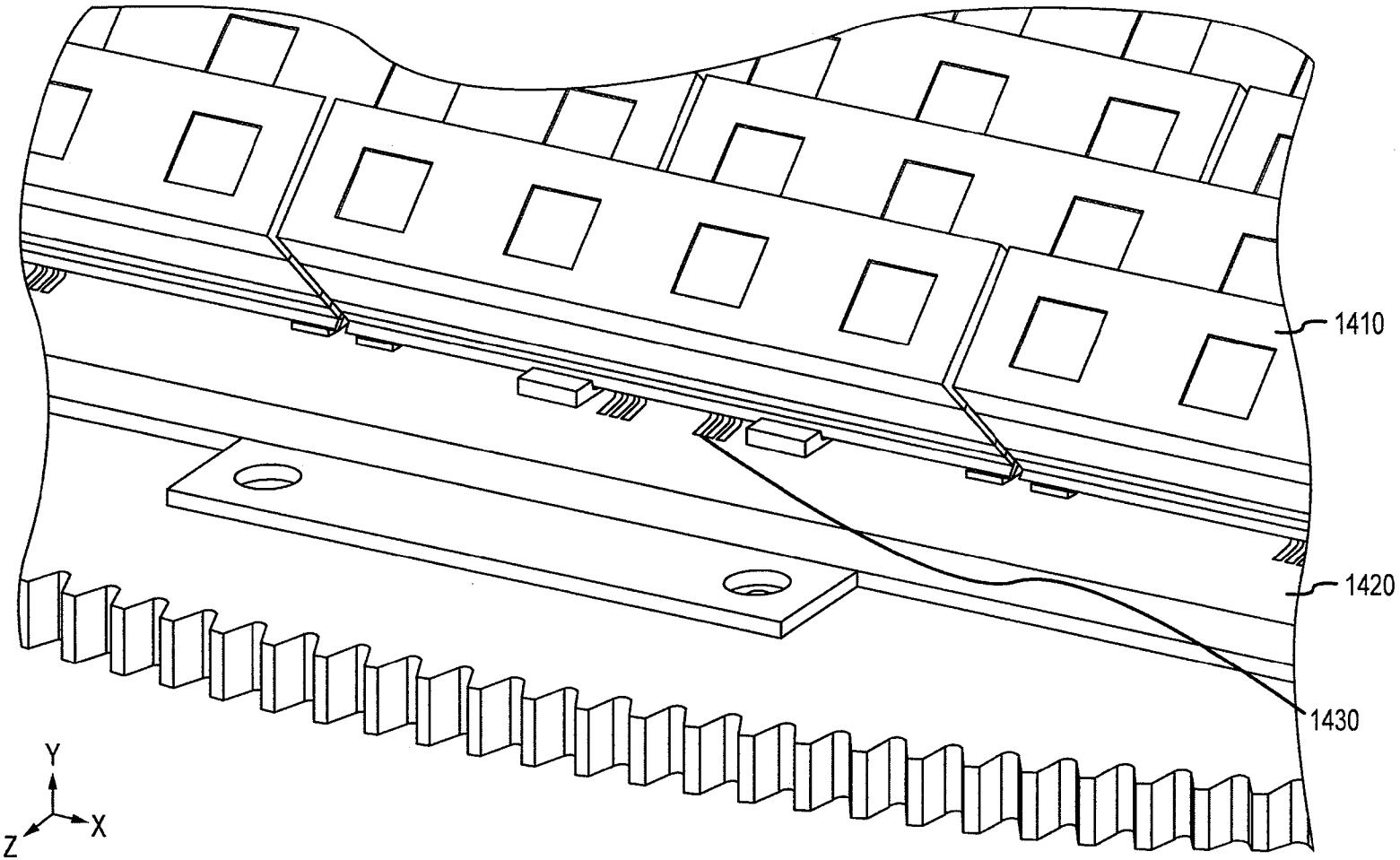
FIG. 14 shows a perspective view of a close-up example of an antenna module with a leads connection to a steering printed circuit board.

With reference to FIG. 14, a radiating module 1410, such as the exemplary radiating module described with reference to FIG. 10, is connected to a steering card 1420 via leads (1430 typ.). In an exemplary embodiment, lead 1430 is pre-bent to substantially match the angle between the steering card 1420 and the radiating module 1410.

Figure 15A:
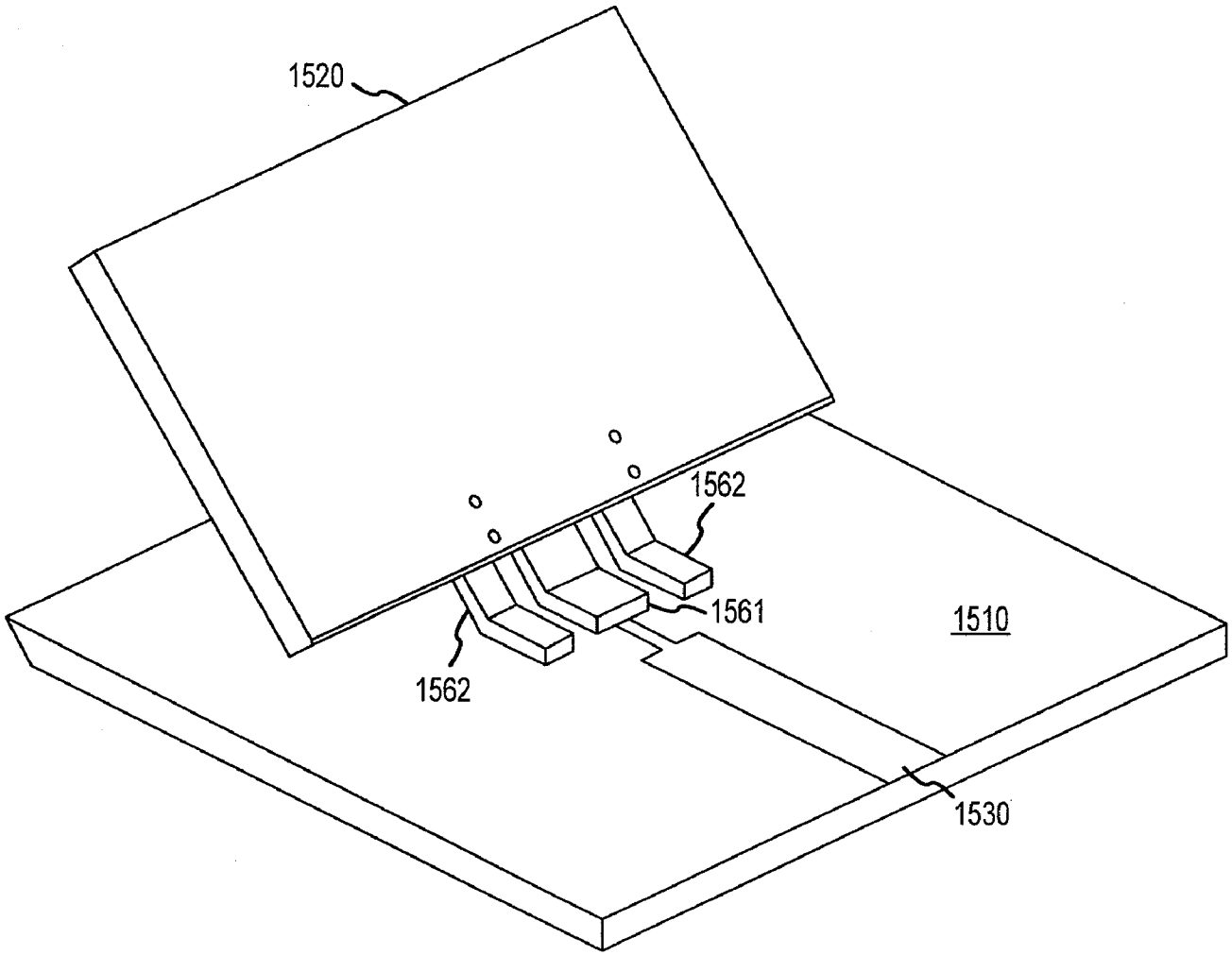
FIGS. 15A, 15B shows perspective views of an exemplary RF lead interface.
Figure 15B:
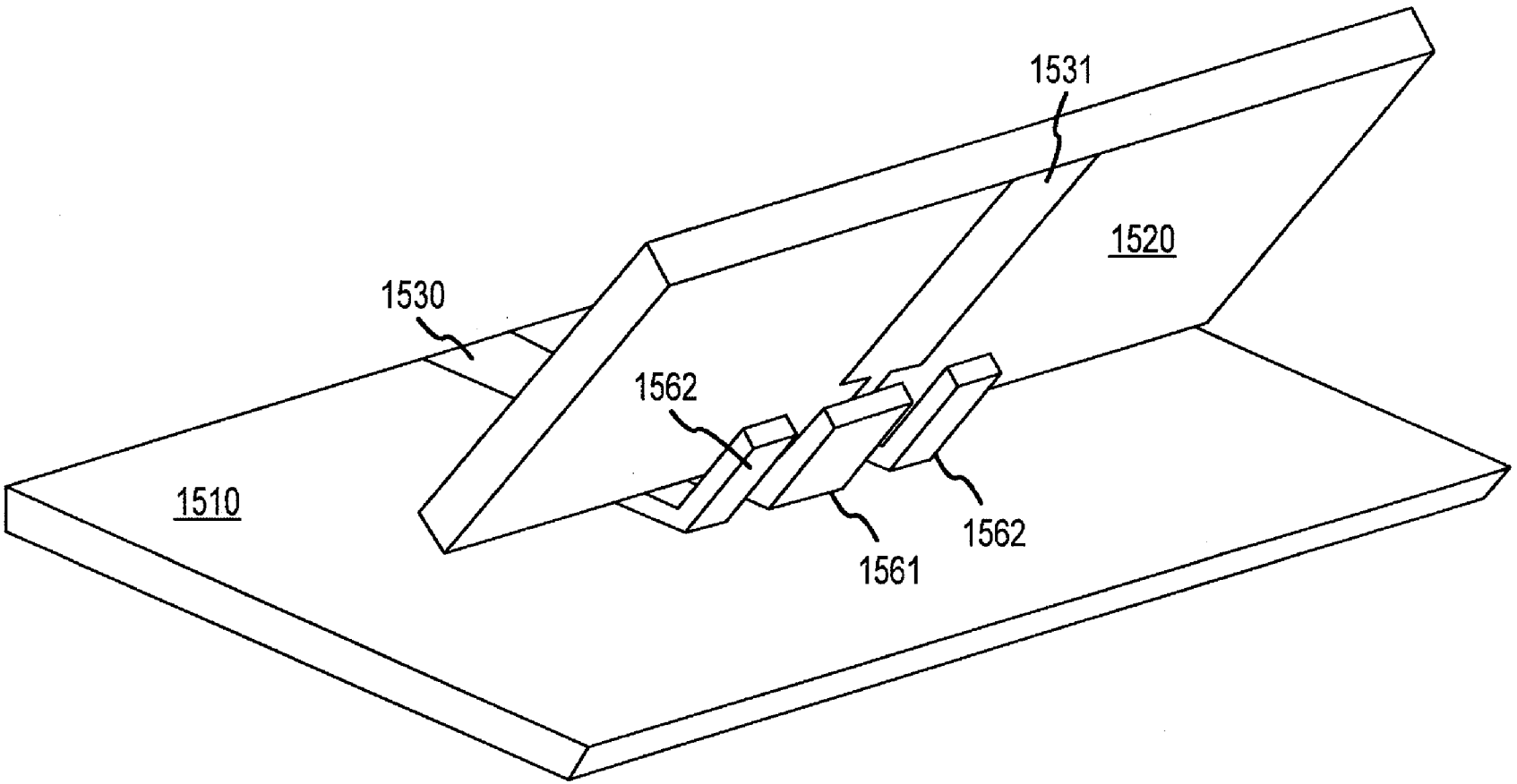

Furthermore, and with reference to FIGS. 15A and 15B, an exemplary interface between a steering card 1510 and a radiating element PCB 1520 is shown. In an exemplary embodiment, a microstrip line 1530 is located on steering card 1510 and connects to one or more lead pads 1540, which in turn connect to a microstrip line 1531 on steering card 1510. In addition, in another embodiment, ground vias (not shown) are located between lead pads (not shown) and steering card 1510. In an exemplary embodiment, the lead pads are underneath and connect to a group of leads, which includes two ground leads 1562 and a signal lead 1561.

In an exemplary embodiment, signal lead 1561 facilitates the transmission of a signal between radiating element PCB 1520 and steering card 1510. In the exemplary embodiment, a first end of signal lead 1561 connects to microstrip line 1530 on steering card 1510, and a second end of signal lead 1561 connects to microstrip line 1531 on radiating element PCB 1520.

Figure 16:
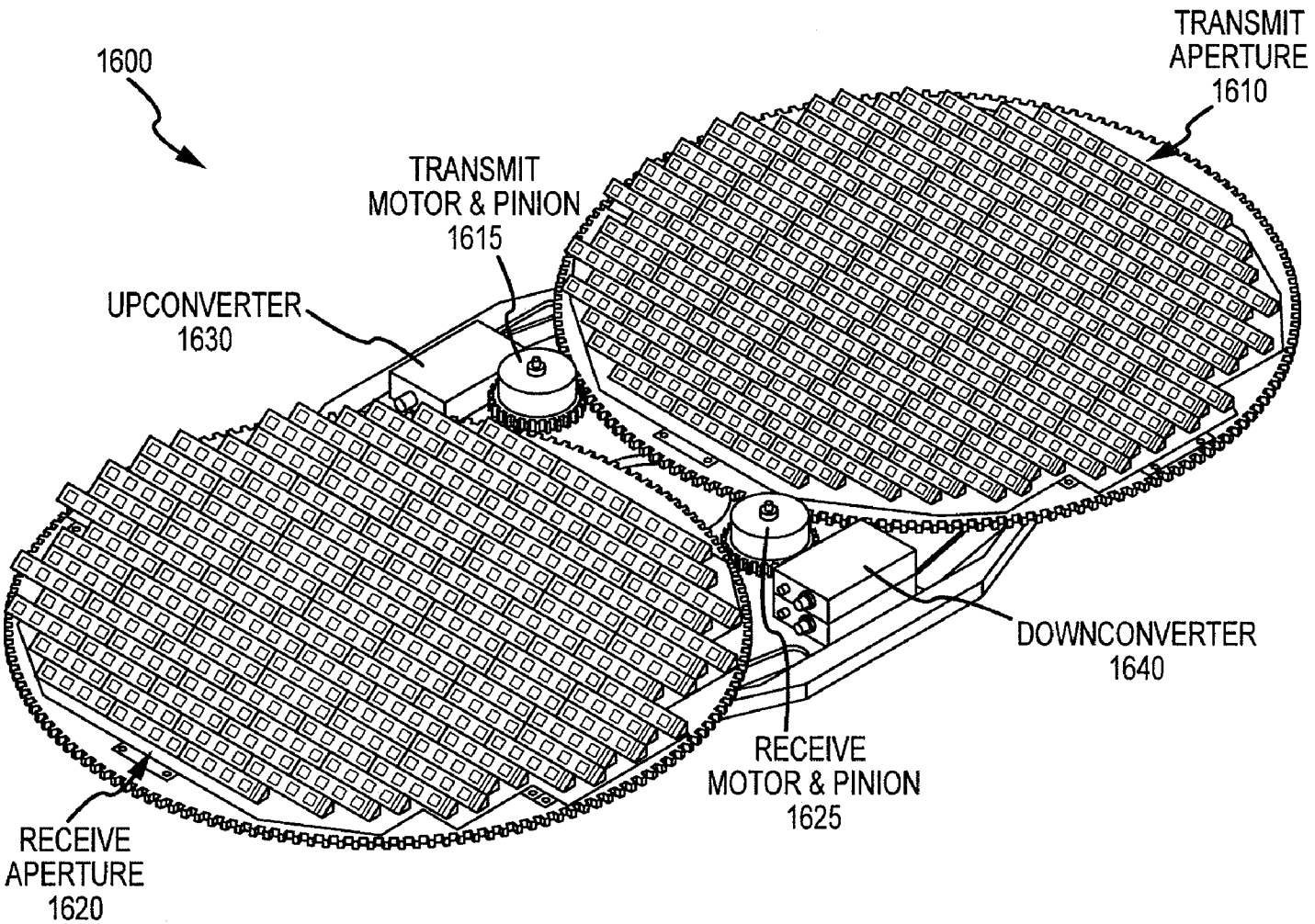
FIG. 16 shows a perspective view of an example of an antenna assembly.

In accordance with an exemplary embodiment and with reference to FIG. 16, a full antenna assembly 1600 includes a transmit aperture 1610, a transmit motor 1615, a receive aperture 1620, a receive motor 1625, an upconvertor 1630, and a downconvertor 1640. Transmit motor 1615 and receive motor 1625 power the rotation in the azimuth plane. Upconvertor 1630 frequency converts an intermediate frequency (IF) signal from a modem up to the transmit RF frequency of the aperture. In addition, downconvertor 1640 frequency converts the receive RF signal from the aperture down to the modem IF frequency.

Furthermore, an antenna module may be connected to another surface in other assemblies, such as an assembly that communicates a signal from one PCB to another. In an exemplary embodiment, the interface connection may be used in U.S. Monolithics products such as the Ka Band XCVR and Link-16 RF modules. Furthermore, the interface connection may be implemented in non-radio frequency applications, for example in communicating a signal from a digital mother board to a daughter card.

Figure 17:
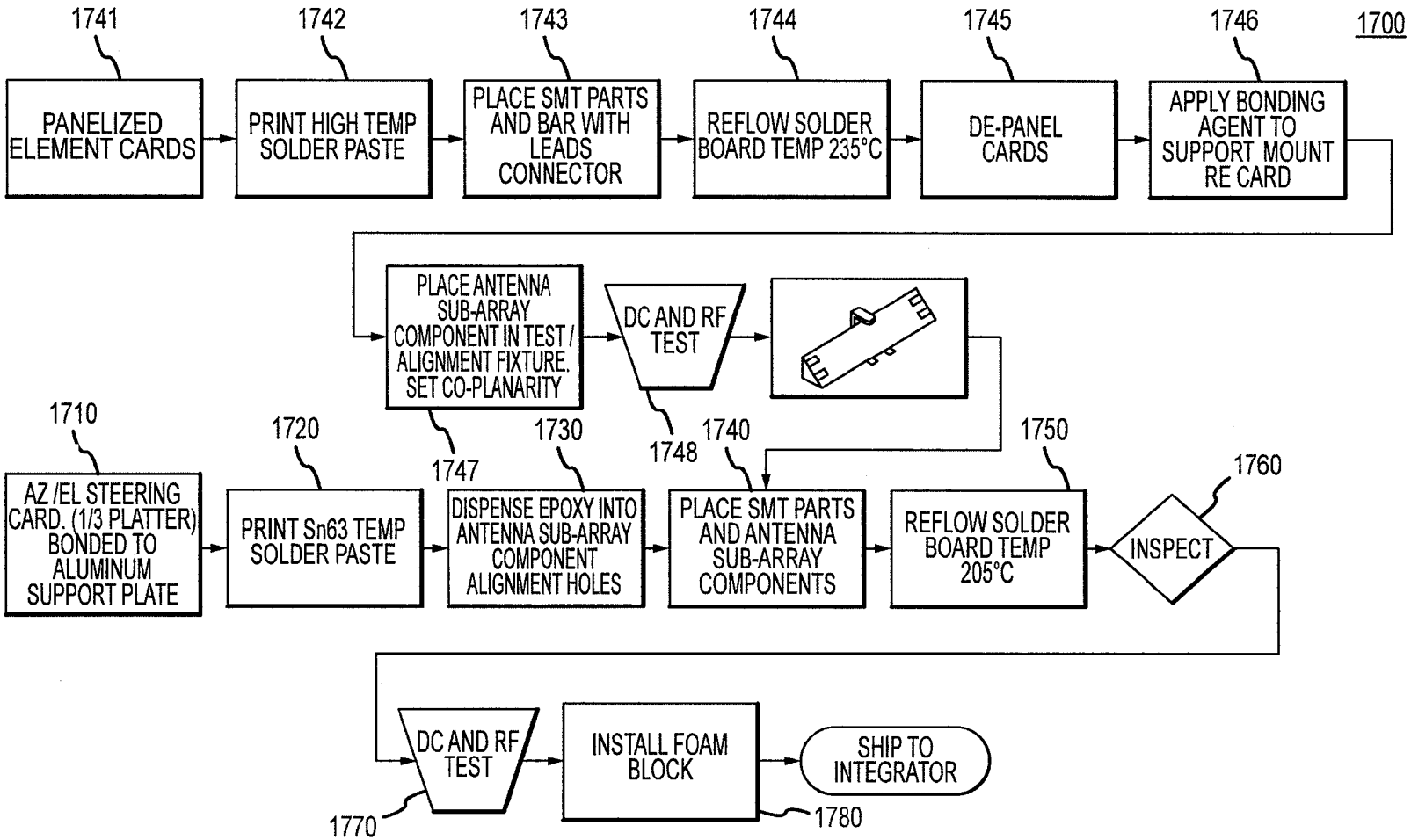
FIG. 17 shows a flow chart of an example of a manufacturing process flow.

In an exemplary method, and with reference to FIG. 17, a manufacturing method 1700 is described herein. A steering card bonds to a support plate (Step 1710). The support plate ensures the assembly is substantially flat, as well as providing thermal transfer, dissipation and a manner for mechanical attachment to the next higher assembly. Additionally, solder paste is added to the steering card (Step 1720). In an exemplary embodiment, the solder paste has a liquidus temperature of about 183° C., thereby allowing attachment of all placed components while not disturbing the solder used to attach components to the radiating element cards.

Furthermore, another step is dispensing epoxy into antenna sub-array super component alignment holes (Step 1730). In one embodiment, epoxy is added as structural support required by the end use environment. Additionally, one step is the placement of the SMT (surface mount technology) parts and antenna sub-array super components (Step 1740) on the steering card. Furthermore, the SMT parts and antenna sub-array super components are attached to the steering card using reflow soldering (Step 1750), in one embodiment at a board temperature of about 205° C. Additionally, method 1700 may further comprise inspecting the board (Step 1760), functional performance testing (Step 1770), and adding foam bricks to the antenna sub-array super component (Step 1780).

The antenna sub-array super components are assembled using various methods. In one exemplary method of manufacture, the bare element PCBs are created in a panelized form (Step 1741) and high temperature solder paste is printed on the element PCBs (Step 1742). In an exemplary embodiment, the liquidus temperature of this solder formulation is about 217° C. and is selected so that parts attached to the super component circuit boards with high temperature solder paste will remain substantially unaffected by the additional soldering process temperature described in Step 1750, wherein steering card components are solder attached in conjunction with the super component leads at a temperature of about 205° C.

Another step is the placement of SMT parts and bar with leads connector (Step 1743) on the element PCBs. After the placement of SMT parts, reflow soldering occurs (Step 1744), in one embodiment at a board temperature of about 235° C. The PCBs are de-paneled, generally once the SMT parts are attached (Step 1745). Furthermore, an additional step in this embodiment is the application of a bonding agent (Step 1746), and attachment of the support bracket which, working in conjunction with the bar with leads connector, creates the form factor of the radiating element module sub-array super component and allows mounting of a super component PCB. Furthermore, an additional step in this embodiment is placing the super component module in a test/alignment fixture and setting co-planarity of the super component module (Step 1747). This method of assembling an antenna sub-array super component may further comprise testing the leads connection from the PCB to a steering card (Step 1748). Additionally, by machine assembling various components, the antenna sub-array super component modules may be manufactured with a high rate of throughput. This in turn lowers the cost of assembly and the cost of the antenna device.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. An inclined element array antenna comprising:

a first radiating element having a first ground plane and a first patch antenna;

a second radiating element having a second ground plane and a second patch antenna; and a mounting surface, wherein the first ground plane and the second ground plane are inclined relative to the mounting surface, wherein the first radiating element and the second radiating element are inclined relative to the mounting surface;

wherein the first radiating element is located in front of the second radiating element on the mounting surface; and wherein the second patch antenna of the second radiating element is configured to have a clear line of sight to the horizon over the first ground plane of the first radiating element.

2. The inclined element array antenna of claim 1, wherein any portion of the second patch antenna is positioned above the ground plane of the first radiating element.

3. The inclined element array antenna of claim 1, wherein a bottom edge of the second patch antenna is positioned completely above the first ground plane of the first radiating element.

4. The inclined element array antenna of claim 3, wherein the second patch antenna is positioned completely above the first ground plane due to the second patch antenna being physically extended from a second ground plane of the second radiating element.

5. The inclined element array antenna of claim 1, wherein a perpendicular distance from the mounting surface to the point of the first ground plane that is farthest from the mounting surface is exceeded by the perpendicular distance from the mounting surface to the point of the second patch antenna that is closest to the mounting surface.

6. The inclined element array antenna of claim 1, wherein the second patch antenna is configured to reduce reflection and scattering effect by the first ground plane of the first radiating element.

7. The inclined element array antenna of claim 1, further comprising a first bar with leads connecting the first radiating element and a second bar with leads connecting the second radiating element to the mounting surface.

8. A radiating element in an inclined antenna array, the radiating element comprising:

a patch antenna with a bottom edge and a top edge, wherein the patch antenna is inclined relative to a mounting surface; and a ground plane with a bottom edge and a top edge, wherein the ground plane is inclined relative to the mounting surface;

wherein the bottom edge of the patch antenna is farther from the mounting surface than the top edge of the ground plane.

9. The radiating element of claim 8, wherein the radiating element connects to the mounting surface using a bar with leads.

10. The radiating element of claim 8, wherein the radiating element is capable of scanning below 20° above horizon.

11. The radiating element of claim 8, wherein the radiating element is inclined from the mounting surface at an angle of at least 20°.

12. A method of reducing radio frequency (RF) signal scattering in an inclined array antenna, the method comprising:

attaching a first radiating element on a mounting surface; and attaching a second radiating element on the mounting surface, wherein the second radiating element further comprises a ground plane;

positioning a patch antenna, associated with the first radiating element, away from the mounting surface and higher than the ground plane of the second radiating element;

wherein the first radiating element is inclined towards the second radiating element.

13. The method of claim 12, wherein positioning the patch antenna comprises structurally supporting the patch antenna a defined distance away from the ground plane.

14. The method of claim 12, further comprising:

arranging a first array comprising the first radiating element in parallel with a second array comprising the second radiating element, wherein the first array and the second array are spaced within a range of 0.4 to 4 wavelengths from each other; and interleaving the first radiating element to be offset from the second radiating element.

15. The method of claim 12, wherein the reducing RF signal scattering results in increased directivity and increased polarization quality in comparison to the patch antenna associated with the first radiating element positioned at the same height as the ground plane of the second radiating element.

16. An antenna system comprising:

a first row of inclined radiating elements, comprising at least a first and second radiating element, wherein the first row of inclined radiating elements are part of a first structure mounted to a mounting structure; and a second row of inclined radiating elements, comprising at least a third and fourth radiating element, wherein the second row of inclined radiating elements are part of a second structure mounted to the mounting structure, wherein the first and second rows of inclined radiating elements are each inclined relative to a surface of the mounting structure;

wherein the first and second radiating elements are spaced apart by a distance of at least the width of the third radiating element, and wherein the third radiating element is aligned with the spacing between the first and second radiating element so that the third radiating element is not blocked by the first row of radiating elements when viewed from a perspective in line with a projection of the second row of inclined radiating elements upon the first row of inclined radiating elements; and wherein the third and fourth radiating elements are spaced apart by a distance of at least the width of the second radiating element, and wherein the second radiating element is positioned to align with the spacing between the third and fourth radiating element.

17. The antenna system of claim 16, wherein the first row of radiating elements is configured to transmit a radio frequency transmit signal, and wherein the second row of radiating elements is configured to receive a radio frequency receive signal.

18. The antenna system of claim 16, wherein the first and second rows of radiating elements each alternate transmit radiating elements and receive radiating elements.

19. An antenna system comprising:

a first array comprising a first set of radiating elements; and a second array comprising a second set of radiating elements;

wherein the second array is located on a mounting surface parallel to the first array, wherein the first array and second array are each inclined relative to the mounting surface; and wherein at least one patch antenna on the second array is higher than at least one ground plane on the first array such that the at least one patch antenna has a clear line of sight to the horizon line.

20. The antenna system of claim 19, wherein all of the at least one patch antenna has a clear line of sight.

21. The antenna system of claim 19, wherein at least a portion of the at least one patch antenna has a clear line of sight.

22. The antenna system of claim 19, wherein at least a majority of the at least one patch antenna has a clear line of sight.

23. An antenna array for attachment to a mounting surface, the antenna array comprising:

a first row of radiating elements; and a second row of radiating elements;

wherein each radiating element comprises a patch antenna having a patch width, a ground plane, and a substrate having a substrate width, wherein the substrate is between the patch antenna and the ground plane;

wherein an angle θ is the angle of the ground plane to the mounting surface; and wherein the substrate is designed with a minimum substrate height of greater than or equal to ½*tan(angle θ)*(patch width+substrate width).

* * * * *